US011854483B2

(12) United States Patent
Ueda et al.

(10) Patent No.: US 11,854,483 B2
(45) Date of Patent: Dec. 26, 2023

(54) DISPLAY DEVICE, PIXEL CIRCUIT, AND METHOD FOR DRIVING SAME

(71) Applicant: Sharp Kabushiki Kaisha, Sakai (JP)

(72) Inventors: Naoki Ueda, Sakai (JP); Ryohei Morita, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/770,402

(22) PCT Filed: Oct. 31, 2019

(86) PCT No.: PCT/JP2019/042776
§ 371 (c)(1),
(2) Date: Apr. 20, 2022

(87) PCT Pub. No.: WO2021/084683
PCT Pub. Date: May 6, 2021

(65) Prior Publication Data

US 2022/0392402 A1 Dec. 8, 2022

(51) Int. Cl.
*G09G 3/325* (2016.01)
*G09G 3/3291* (2016.01)

(52) U.S. Cl.
CPC ..... *G09G 3/325* (2013.01); *G09G 3/3291* (2013.01); *G09G 2320/0233* (2013.01); *G09G 2330/021* (2013.01)

(58) Field of Classification Search
CPC ..... G09G 3/325; G09G 3/3291; G09G 2320/0233; G09G 2330/021
See application file for complete search history.

(56) References Cited

U.S. PATENT DOCUMENTS 10,872,566 B2 * 12/2020 Qu ..... G09G 3/3291
2004/0056252 A1 * 3/2004 Kasai ..... G09G 3/3233 257/72

(Continued)

FOREIGN PATENT DOCUMENTS

JP 2003-022049 A 1/2003
JP 2009-251546 A 10/2009
JP 2018-087981 A 6/2018

OTHER PUBLICATIONS

Official Communication issued in International Patent Application No. PCT/JP2019/042776, dated Jan. 28, 2020.

*Primary Examiner* — Kenneth B Lee, Jr.
(74) *Attorney, Agent, or Firm* — Keating & Bennett, LLP

(57) ABSTRACT

The present application discloses a current-driven display device of an internal compensation type in which threshold compensation of a drive transistor is appropriately performed without causing a decrease in display quality or a decrease in yield during manufacturing, and display luminance is improved while a drive voltage is maintained. A pixel circuit 15 in the display device includes first and second drive transistors M1*a*, M1*b*, and the gate terminals thereof are connected to each other and connected to a holding capacitor Cs. During the data write period, a voltage of a corresponding data signal line Dj is written to the holding capacitor Cs via the first drive transistor M1*a*, having been set in a diode connection mode by a threshold compensation transistor M3, to perform data writing accompanied by threshold compensation. During the emission period, a current corresponding to the sum of currents I1, I2 flowing through the first and second drive transistors M1*a*, M1*b* in accordance with the holding voltage of the holding capacitor Cs is supplied to an organic EL element OL as a drive current Id.

19 Claims, 14 Drawing Sheets

(56) References Cited

U.S. PATENT DOCUMENTS

| | | | | |
|---|---|---|---|---|
| 2007/0126664 | A1 | 6/2007 | Kimura | |
| 2021/0056902 | A1* | 2/2021 | Tanaka | G09G 3/3291 |
| 2022/0044636 | A1* | 2/2022 | Mou | G09G 3/3233 |
| 2022/0165214 | A1* | 5/2022 | Liu | G09G 3/3233 |

* cited by examiner

DISPLAY DEVICE, PIXEL CIRCUIT, AND METHOD FOR DRIVING SAME

TECHNICAL FIELD

The disclosure relates to a display device, and more particularly to a current-driven display device including a display element driven by a current such as an organic electroluminescence (EL) element, a pixel circuit in the display device, and a method for driving the pixel circuit.

BACKGROUND ART

In recent years, an organic EL display device provided with a pixel circuit including an organic EL element (also referred to as an organic light-emitting diode (OLED)) has been put into practical use. The pixel circuit of the organic EL display device includes, in addition to the organic EL element, a drive transistor, a writing control transistor, a holding capacitor, and the like. A thin-film transistor is used for the drive transistor and the writing control transistor, the holding capacitor is connected to a gate terminal serving as the control terminal of the drive transistor, and a voltage corresponding to a video signal representing an image to be displayed (more specifically, a voltage indicating a gradation value of a pixel to be formed in the pixel circuit) is supplied as a data voltage to the holding capacitor from a drive circuit via a data signal line. The organic EL element is a self-emitting display element that emits light with a luminance corresponding to a current flowing therethrough. The drive transistor is provided in series with the organic EL element and controls the current flowing through the organic EL element in accordance with the voltage held in the holding capacitor.

Variations or shifts occur in the characteristics of the organic EL element and the drive transistor. Thus, for performing a high-quality display in the organic EL display device, it is necessary to compensate for variations and shifts in the characteristics of these elements. As for the organic EL display device, a method of compensating for the characteristics of the element inside the pixel circuit and a method of compensating for the characteristics outside the pixel circuit are known. As a pixel circuit corresponding to the former method, there is known a pixel circuit configured to initialize a voltage at a gate terminal of a drive transistor, that is, a voltage held in a holding capacitor, and then charge the holding capacitor with a data voltage via the drive transistor in a diode connection mode. On the inside of such a pixel circuit, variations and shifts in the threshold voltage in the drive transistor are compensated for (hereinafter, the compensation for the variations and shifts in the threshold voltage will be referred to as "threshold compensation").

CITATION LIST

Patent Documents

[Patent Document 1] Japanese Laid-Open Patent Publication No. 2009-251546

[Patent Document 2] Japanese Laid-Open Patent Publication No. 2018-087981

SUMMARY

Technical Problem

As described above, in the organic EL display device of the type of performing threshold compensation in a pixel circuit (hereinafter referred to as "internal compensation type"), it is desired to increase the display luminance more than in the known device while maintaining the drive voltage depending on the application (e.g., in a case where the display panel is medium). In this case, in the pixel circuit as described above, it is necessary to use a drive transistor having a channel width much larger than the known one in order to increase the luminance. On the other hand, when the channel width of the drive transistor is increased, the transconductance of the drive transistor increases, and hence at the time of writing the data voltage to the holding capacitor, the change rate of the holding voltage of the holding capacitor, that is, the change rate of the voltage of the gate terminal of the drive transistor, increases. As a result, the holding capacitor is excessively charged or discharged, and the threshold compensation described above cannot be performed appropriately. In order to appropriately perform the threshold compensation, it is necessary to increase a capacitance value of the holding capacitor (hereinafter referred to as "holding capacitance value") in accordance with an increase in the transconductance of the drive transistor (e.g., it is necessary to change the capacitance value from about 70 fF to about 800 fF). However, when the holding capacitance value is increased in the pixel circuit as described above, the following problems occur.

That is, in the initialization period of the pixel circuit, the holding capacitor in the pixel circuit cannot be sufficiently initialized, and as a result, the gradation expressing capability in the display device may deteriorate.

Meanwhile, when the channel width of an initialization transistor connected to the holding capacitor is increased so as to sufficiently initialize the holding capacitor, the accumulated charge is insufficiently held in the holding capacitor during a display period during which the initialization transistor is to be in an off-state, and bright dot abnormality, flicker, or the like may occur. In addition, a significant increase in the holding capacitance value leads to extreme expansion of an area occupied by the holding capacitor in the pixel circuit, which causes a problem of a decrease in yield during manufacturing.

Therefore, in the current-driven display device of the internal compensation type, it is desirable to appropriately perform the threshold compensation of the drive transistor without causing a decrease in display quality or a decrease in yield during manufacturing, and to improve display luminance while maintaining the drive voltage.

Solution to Problem

Several embodiments of the disclosure provide a pixel circuit provided to correspond to any one of a plurality of data signal lines and correspond to any one of a plurality of scanning signal lines intersecting the plurality of data signal lines in a display device including a display portion in which the plurality of data signal lines and the plurality of scanning signal lines are arranged, the pixel circuit being driven periodically with a predetermined period, including a data write period and a display period, as one cycle, the pixel circuit including:

a display element driven by a current;

a holding capacitor;

first and second drive transistors each configured to supply a current corresponding to a holding voltage of the holding capacitor to the display element during the display period; and a threshold compensation switching element that is connected between a control terminal and a first conduction terminal of the first drive transistor and is turned on during the data write period to set the first drive transistor in a diode connection mode, wherein the pixel circuit is configured such that during the data write period, by supply of a voltage of a corresponding data signal line to the holding capacitor via the first drive transistor in the diode connection mode, a data voltage corrected so as to compensate for a threshold voltage of the first drive transistor is written to the holding capacitor, and such that during the display period, a current flowing through the first drive transistor based on the corrected data voltage and a current flowing through the second drive transistor based on the corrected data voltage are supplied to the display element as drive currents.

Several other embodiments of the disclosure provide a display device including a display portion in which a plurality of data signal lines and a plurality of scanning signal lines intersecting the plurality of data signal lines are disposed, the display device including:

a plurality of pixel circuits disposed along the plurality of data signal lines and the plurality of scanning signal lines such that each of the pixel circuits corresponds to any one of the plurality of data signal lines and corresponds to any one of the plurality of scanning signal lines, each of the pixel circuit being driven periodically with a predetermined period, including a data write period and a display period, as one cycle, a data signal line drive circuit configured to drive the plurality of data signal lines; and a scanning signal line drive circuit configured to selectively drive the plurality of scanning signal lines, wherein each of the pixel circuits includes a display element driven by a current, a holding capacitor, first and second drive transistors each configured to supply a current corresponding to a holding voltage of the holding capacitor to the display element during the display period, a threshold compensation switching element that is connected between a control terminal and a first conduction terminal of the first drive transistor and is turned on during the data write period to set the first drive transistor in a diode connection mode, and each of the pixel circuits is configured such that during the data write period, by supply of a voltage of a corresponding data signal line to the holding capacitor via the first drive transistor in the diode connection mode, a data voltage corrected so as to compensate for a threshold voltage of the first drive transistor is written to the holding capacitor, and such that during the display period, a current flowing through the first drive transistor based on the corrected data voltage and a current flowing through the second drive transistor based on the corrected data voltage are supplied to the display element as drive currents.

Still other embodiments of the disclosure provide a method for driving a pixel circuit provided to correspond to any one of a plurality of data signal lines and correspond to any one of a plurality of scanning signal lines intersecting the plurality of data signal lines in a display device including a display portion in which the plurality of data signal lines and the plurality of scanning signal lines are arranged, the pixel circuit including a display element driven by a current, a holding capacitor, first and second drive transistors each configured to supply a current corresponding to a holding voltage of the holding capacitor to the display element, and a threshold compensation switching element that is connected between a control terminal and a first conduction terminal of the first drive transistor and is turned on to set the first drive transistor in a diode connection mode, the method including:

a data writing step of turning on the threshold compensation switching element to set the first drive transistor in a diode connection mode, and supplying a voltage of a data signal line corresponding to the pixel circuit to the holding capacitor via the first drive transistor in a diode connection mode to write to the holding capacitor a data voltage corrected so as to compensate a threshold of the first drive transistor; and a display step of supplying the display element with a current flowing through the first drive transistor based on the corrected data voltage and a current flowing through the second drive transistor based on the corrected data voltage as drive currents to cause the display element to emit light.

Effects of the Disclosure

According to some embodiments of the disclosure, in a pixel circuit in a display device including a display portion in which a plurality of data signal lines and a plurality of scanning signal lines intersecting the plurality of data signal lines are disposed, during a data write period, by supply of a voltage of a data signal line corresponding to the pixel circuit to a holding capacitor via a first drive transistor in a diode connection mode, a data voltage corrected so as to compensate for a threshold voltage of the first drive transistor is written to the holding capacitor, and during a display period, a current flowing through the first drive transistor based on the corrected data voltage and a current flowing through a second drive transistor based on the corrected data voltage are supplied to the display element as drive currents. In this way, during the data write period, the current for writing the data voltage corrected so as to compensate for the threshold to the holding capacitor is supplied from the first drive transistor of the two drive transistors provided in the pixel circuit to the holding capacitor, and during the display period, the current corresponding to the sum of the currents flowing through the first and second drive transistors is supplied to the display element in accordance with the voltage written to the holding capacitor. Therefore, it is possible to increase the drive current of the display element without increasing the drive voltage while appropriately performing the threshold compensation of the drive transistor without increasing the capacitance value of the holding capacitor. As a result, it is possible to appropriately perform the threshold compensation of the drive transistor without causing a decrease in display quality or a decrease in yield during manufacturing, and to improve display luminance while maintaining the drive voltage.

DESCRIPTION OF EMBODIMENTS

Each embodiment will be described below with reference to the accompanying drawings. In each transistor described below, a gate terminal corresponds to a control terminal, one of a drain terminal and a source terminal corresponds to a first conduction terminal, and the other corresponds to a second conduction terminal. A description will be given assuming that all of the transistors in the following embodiments are of a P-channel type, but the disclosure is not limited thereto. Further, the transistor in each embodiment is, for example, a thin-film transistor, but the disclosure is not limited thereto. Moreover, the term "connection" in the present specification means "electrical connection" unless otherwise specified, and includes not only the case of meaning direct connection but also the case of meaning indirect connection via another element in the scope not deviating from the gist of the disclosure.

1. First Embodiment

<1.1 Overall Configuration>

Figure 1:
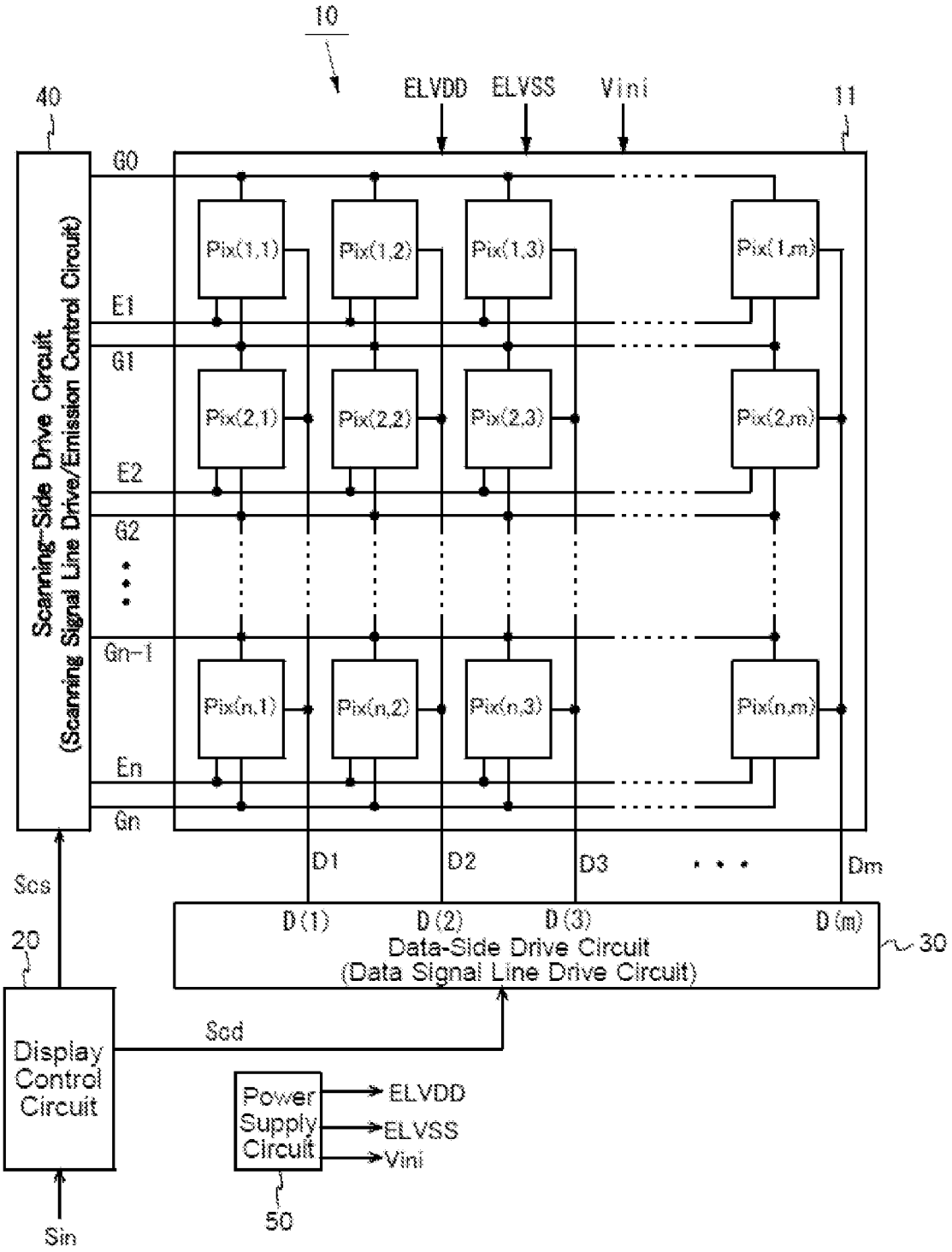
FIG. 1 is a block diagram showing an overall configuration of an organic EL display device of an internal compensation type.

FIG. 1 is a block diagram showing an overall configuration of an organic EL display device 10 of an internal compensation type. In the display device 10, each pixel circuit has a function of compensating for variations and shifts in a threshold voltage of an internal drive transistor (details will be described later). As the pixel circuit in the display device 10, a pixel circuit according to a first embodiment can be used.

As shown in FIG. 1, the display device 10 includes a display portion 11, a display control circuit 20, a data-side drive circuit 30, a scanning-side drive circuit 40, and a power supply circuit 50. The data-side drive circuit functions as a data signal line drive circuit (also referred to as a "data driver"). The scanning-side drive circuit 40 functions as a scanning signal line drive circuit (also referred to as a "gate driver") and an emission control circuit (also referred to as an "emission driver"). In the configuration shown in FIG. 1, the two drive circuits are implemented as one scanning-side drive circuit 40, but the two drive circuits may be appropriately separated, or the two drive circuits may be separated and disposed on one side and the other side of the display portion 11. At least a part of each of the scanning-side drive circuit and the data-side drive circuit may be integrally formed with the display portion 11. These points also apply to other embodiments and modifications to be described later. The power supply circuit 50 generates a high-level power supply voltage ELVDD, a low-level power supply voltage ELVSS, and an initialization voltage Vini, described later, to be supplied to the display portion 11, and generates power supply voltages (not shown) to be supplied to the display control circuit 20, the data-side drive circuit 30, and the scanning-side drive circuit 40.

In the display portion 11, m (m is an integer of 2 or more) data signal lines D1 to Dm and n+1 (n is an integer of 2 or more) scanning signal lines G0 to Gn intersecting the data signal lines D1 to Dm are disposed, and n emission control lines (emission lines) E1 to En are disposed along the n scanning signal lines G1 to Gn, respectively. The display portion 11 is provided with m×n pixel circuits Pix(i,j) arranged in a matrix along the m data signal lines D1 to Dm and the n scanning signal lines G1 to Gn (i=1 to n, j=1 to m), and each pixel circuit Pix(i,j) corresponds to any one of the m data signal lines D1 to Dm and corresponds to any one of the n scanning signal lines G1 to Gn. Here, the "pixel circuit Pix(i,j)" is a pixel circuit corresponding to an ith scanning signal lin Gi and a jth data signal line Dj and is also referred to as "the pixel circuit in the ith row and the jth column". As described above, since the n emission control lines E1 to En correspond to the n scanning signal lines G1 to Gn respectively, each pixel circuit Pix(i,j) also corresponds to any one of the n emission control lines E1 to En.

In the display portion 11, power supply lines (not shown) common to all the pixel circuits Pix(1, 1) to Pix(n,m) are disposed. That is, a first power supply voltage line and a second power supply voltage line are disposed, the first power supply voltage line being configured to supply a high-level power supply voltage ELVDD for driving the organic EL element to be described later (hereinafter, the line will be referred to as a "high-level power line" and denoted by the same reference symbol "ELVDD" as the high-level power supply voltage), the second power supply voltage line being configured to supply a low-level power supply voltage ELVSS for driving the organic EL element (hereinafter, the line will be referred to as a "low-level power line" and denoted by the same reference symbol "ELVSS" as the low-level power supply voltage). Moreover, the display portion 11 is also provided with an initialization voltage supply line (denoted by the same reference symbol "Vini" as the initialization voltage) for supplying an initialization voltage Vini to be used for a reset operation for initializing each pixel circuit Pix(i,j). The high-level power supply voltage ELVDD, the low-level power supply voltage ELVSS, and the initialization voltage Vini are supplied from the power supply circuit 50.

The display control circuit 20 receives an input signal Sin including image information representing an image to be displayed and timing control information for image display from the outside of the display device 10, generates a data-side control signal Scd and a scanning-side control signal Scs based on the input signal Sin, and outputs the data-side control signal Scd and the scanning-side control signal Scs to the data-side drive circuit (data signal line drive circuit) 30 and the scanning-side drive circuit (scanning signal line drive/emission control circuit) 40, respectively.

The data-side drive circuit 30 drives the data signal lines D1 to Dm based on the data-side control signal Scd from the display control circuit 20. That is, based on the data-side control signal Scd, the data-side drive circuit 30 outputs m data signals D(1) to D(m) representing an image to be displayed in parallel and applies the data signals D(1) to D(m) to the data signal lines D1 to Dm, respectively.

The scanning-side drive circuit 40 functions as a scanning signal line drive circuit for driving the scanning signal lines G0 to Gn, and an emission control circuit for driving the emission control lines E1 to En based on the scanning-side control signal Scs from the display control circuit 20.

More specifically, the scanning-side drive circuit 40 sequentially selects the scanning signal lines G0 to Gn in each frame period for a predetermined period corresponding to one horizontal period based on the scanning-side control signal Scs as the scanning signal line drive circuit, applies an active signal (low-level voltage) to the selected scanning signal line Gk, and applies an inactive signal (high-level voltage) to the non-selected scanning signal line. Thus, m pixel circuits Pix(k, 1) to Pix(k,m) corresponding to the selected scanning signal lines Gk ($1 \leq k \leq n$) are selected collectively. As a result, the voltages of the m data signals D(1) to D(m) (hereinafter, these voltages may be simply referred to as "data voltage" without distinction) applied from the data-side drive circuit 30 to the data signal lines D1 to Dm during a selection period for the scanning signal line Gk (hereinafter referred to as "kth scanning selection period") are written as pixel data to the pixel circuits Pix(k, 1) to Pix(k,m), respectively.

As the emission control circuit, based on the scanning-side control signal Scs, the scanning-side drive circuit 40 applies an emission control signal (high-level voltage) indicating non-emission to an ith emission control line Ei during an (i−1)th horizontal period and an ith horizontal period and applies an emission control signal (low-level voltage) indicating light emission during the other periods (see FIG. 4 to be described later). While the voltage of the emission control line Ei is at a low level, the organic EL elements in the pixel circuits Pix(i, 1) to Pix(i,m) corresponding to the ith scanning signal line Gi (hereinafter also referred to as "pixel circuits in the ith row") emit light with luminance corresponding to the data voltages written respectively in the pixel circuits Pix(i, 1) to Pix(i,m) in the ith row.

<1.2 Configuration of Pixel Circuit>

<1.2.1 Configuration of Known Pixel Circuit>

Figure 2:
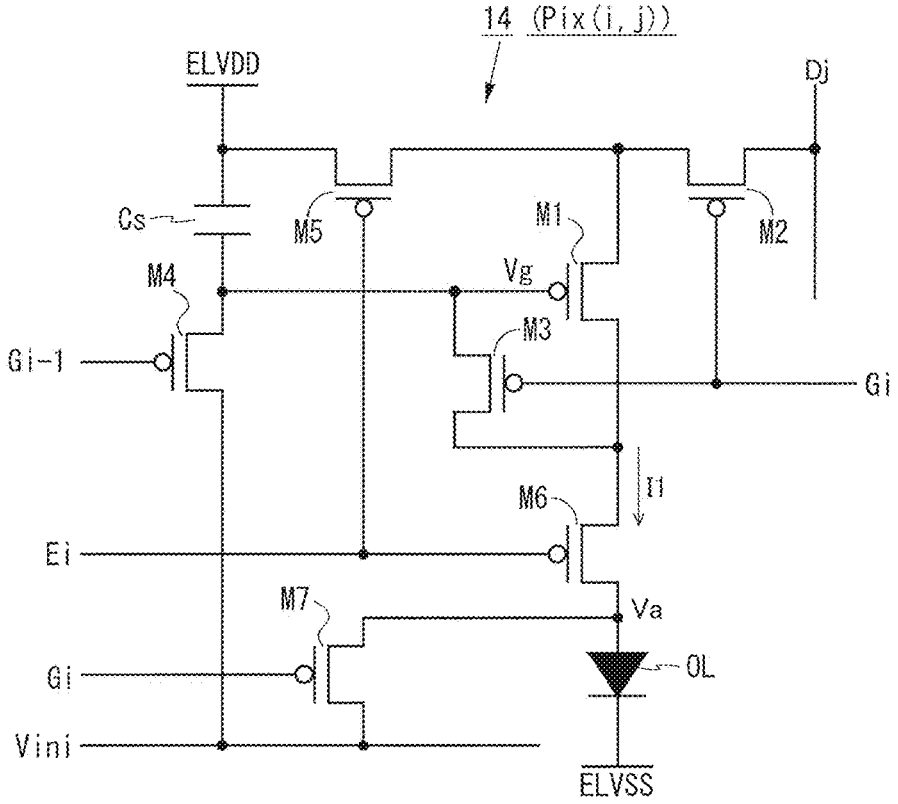
FIG. 2 is a circuit diagram showing a configuration of a known pixel circuit that can be used in the display device of FIG. 1.

FIG. 2 is a circuit diagram showing a configuration of a known pixel circuit 14 that can be used as a pixel circuit Pix(i,j) in the display device 10 of FIG. 1.

As shown in FIG. 2, the pixel circuit 14 includes an organic EL element OL as a display element, a drive transistor M1, a writing control transistor M2, a threshold compensation transistor M3, a first initialization transistor M4, a power supply transistor M5, an emission control transistor M6, a second initialization transistor M7, and a holding capacitor Cs. In the pixel circuit 14, the transistors M2 to M7 except for the drive transistor M1 function as switching elements.

The pixel circuit 14 is connected with a scanning signal line (hereinafter also referred to as "corresponding scanning signal line" in the description focusing on the pixel circuit) Gi corresponding to the pixel circuit 14, a scanning signal line (a scanning signal line immediately before in the scanning order of the scanning signal lines G1 to Gn, hereinafter also referred to as "preceding scanning signal line" in the description focusing on the pixel circuit) Gi−1 immediately before the corresponding scanning signal line Gi, an emission control line (hereinafter also referred to as "corresponding emission control line" in the description focusing on the pixel circuit) Ei corresponding to the pixel circuit 14, a data signal line (hereinafter also referred to as "corresponding data signal line" in the description focusing on the pixel circuit) Dj corresponding to the pixel circuit 14, an initialization voltage supply line Vini, a high-level power line ELVDD, and a low-level power line ELVSS.

As shown in FIG. 2, in the pixel circuit 14, the source terminal of the drive transistor M1 is connected to the corresponding data signal line Dj via the writing control transistor M2 and is connected to the high-level power line ELVDD via the power supply transistor M5. The drain terminal of the drive transistor M1 is connected to the anode electrode of the organic EL element OL via the emission control transistor M6. The gate terminal of the drive transistor M1 is connected to the high-level power line ELVDD via the holding capacitor Cs, is connected to the drain terminal of the drive transistor M1 via the threshold compensation transistor M3, and is connected to the initialization voltage supply line Vini via the first initialization transistor M4. The anode electrode of the organic EL element OL is connected to the initialization voltage supply line Vini via the second initialization transistor M7, and the cathode electrode of the organic EL element OL is connected to the low-level power line ELVSS. The gate terminals of the writing control transistor M2 and the threshold compensation transistor M3 are connected to the corresponding scanning signal line Gi, the gate terminals of the power supply transistor M5 and the emission control transistor M6 are connected to the corresponding emission control line Ei, the gate terminal of the first initialization transistor M4 is connected to the preceding scanning signal line Gi−1, and the gate terminal of the second initialization transistor M7 is connected to the corresponding scanning signal line Gi. Note that the gate terminal of the second initialization transistor M7 may be connected to the preceding scanning signal line Gi−1 instead of the corresponding scanning signal line Gi.

The drive transistor M1 operates in a saturation region, and a drive current I1 flowing through the organic EL element OL during an emission period as a display period is given by Equation (1) below: A gain β of the drive transistor M1 included in Equation (1) is given by Equation (2) below.

$$I1 = (\beta/2)(|Vgs| - |Vth|)^2 \tag{1}$$

$$= (\beta/2)(|Vg - ELVDD| - |Vth|)^2$$

$$\beta = \mu \times (W/L) \times Cox \tag{2}$$

In Equations (1) and (2) above, Vg, Vgs, Vth, μ, W, L, and Cox respectively represent the voltage of the gate terminal (hereinafter referred to as "gate voltage"), the gate-source voltage, the threshold, the mobility, the channel width, the channel length, and the gate insulating film capacitance per unit area of the drive transistor M1.

<1.2.2 Configuration of Pixel Circuit According to First Embodiment>

Figure 3:
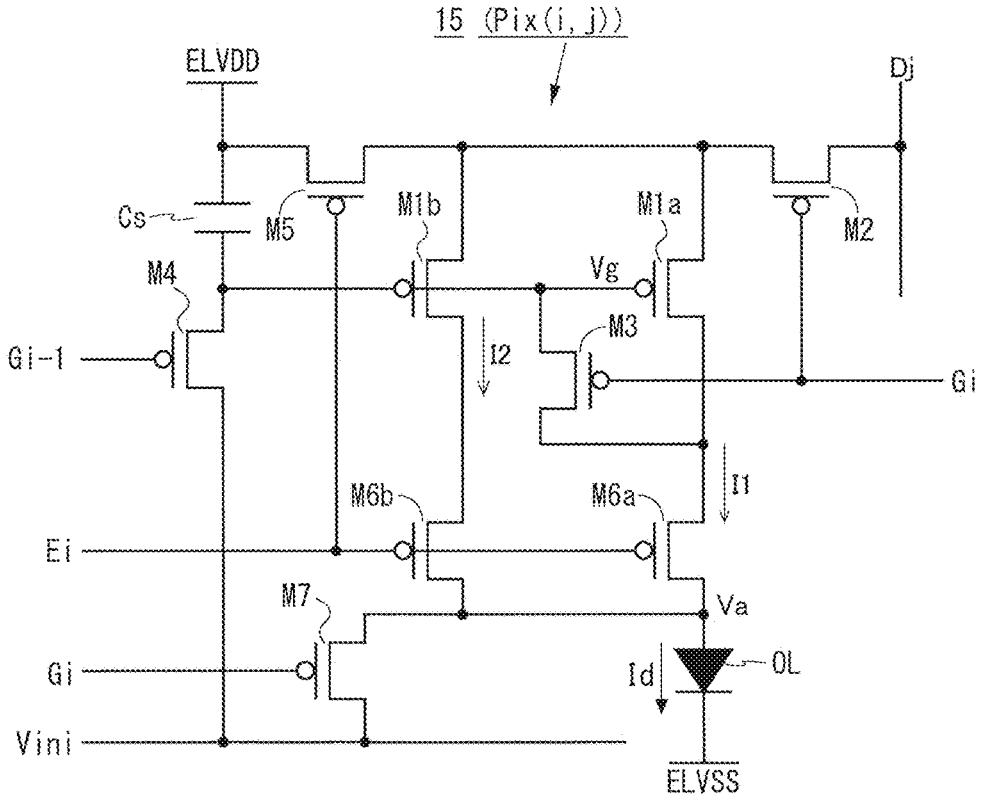
FIG. 3 is a circuit diagram showing a configuration of a pixel circuit according to a first embodiment that can be used in the display device of FIG. 1.

FIG. 3 is a circuit diagram showing the configuration of the pixel circuit 15 according to the first embodiment that can be used as the pixel circuit Pix(i,j) in the display device 10 of FIG. 1.

As shown in FIG. 3, the pixel circuit 15 includes the organic EL element OL as the display element, first and second drive transistors M1*a*, M1*b*, the writing control transistor M2, the threshold compensation transistor M3, the first initialization transistor M4, the power supply transistor M5, first and second emission control transistors M6*a*, M6*b*, the second initialization transistor M7, and the holding capacitor Cs. In the pixel circuit 15, the transistors M2 to M7 other than the first and second drive transistors M1*a*, M1*b* function as switching elements, and the first drive transistor M1*a* and the first emission control transistor M6*a* correspond to the drive transistor M1 and the emission control transistor M6 in the known pixel circuit 14 (FIG. 2), respectively. The second drive transistor M1*b* is provided to improve the capability of driving the organic EL element OL in the pixel circuit 15, and the second emission control transistor M6*b* is provided to prevent the second drive transistor M1*b* from being involved in the data writing operation accompanied by threshold compensation (details will be described later). Among the components of the pixel circuit 15, the same components as those in the known pixel circuit 14 are denoted by the same reference numerals (see FIGS. 2 and 3).

Similarly to the known pixel circuit 14, the pixel circuit 15 is also connected with the corresponding scanning signal line Gi, the preceding scanning signal line Gi−1, the corresponding emission control line Ei, the corresponding data signal line Dj, the initialization voltage supply line Vini, the high-level power line ELVDD, and the low-level power line ELVSS.

As shown in FIG. 3, in the pixel circuit 15, the source terminal of the first drive transistor M1*a* is connected to the corresponding data signal line Dj via the writing control transistor M2 and is connected to the high-level power line ELVDD via the power supply transistor M5. The drain terminal of the first drive transistor M1*a* is connected to an anode electrode of the organic EL element OL via the first emission control transistor M6*a*. The gate terminal of the first drive transistor M1*a* is connected to the high-level power line ELVDD via the holding capacitor Cs, is connected to the drain terminal of the first drive transistor M1*a* via the threshold compensation transistor M3, and is connected to the initialization voltage supply line Vini via the first initialization transistor M4. The anode electrode of the organic EL element OL is connected to the initialization voltage supply line Vini via the second initialization transistor M7, and the cathode electrode of the organic EL element OL is connected to the low-level power line ELVSS.

In the pixel circuit 15, the source terminal of the second drive transistor M1*b* is connected to the source terminal of the first drive transistor M1*a*, and is thus connected to the corresponding data signal line Dj via the writing control transistor M2 and connected to the high-level power line ELVDD via the power supply transistor M5. The drain terminal of the second drive transistor M1*b* is connected to the anode electrode of the organic EL element OL via the second emission control transistor M6*b*. The gate terminal of the second drive transistor M1*b* is connected to the gate terminal of the first drive transistor M1*a*, and is thus connected to the high-level power line ELVDD via the holding capacitor Cs and connected to the initialization voltage supply line Vini via the first initialization transistor M4.

Similarly to the known pixel circuit 14, in this pixel circuit 15 as well, the gate terminals of the writing control transistor M2 and the threshold compensation transistor M3 are connected to the corresponding scanning signal line Gi, the gate terminals of the power supply transistor M5 and the first and second emission control transistors M6*a*, M6*b* are connected to the corresponding emission control line Ei, the gate terminal of the first initialization transistor M4 is connected to the preceding scanning signal line Gi−1, and the gate terminal of the second initialization transistor M7 is connected to the corresponding scanning signal line Gi. Note that the gate terminal of the second initialization transistor M7 may be connected to the preceding scanning signal line Gi−1 instead of the corresponding scanning signal line Gi.

Both the first and second drive transistors M1*a*, M1*b* operate in the saturation region, and a drive current Id flowing through the organic EL element OL during the emission period as the display period is the sum of a first drive current I1, which is the current flowing through the first drive transistor M1*a*, and a second drive current I2, which is the current flowing through the second drive transistor M1*b*. That is, $$Id=I1+I2 \tag{3}$$

The first drive current I1 included in Equation (3) above is given by Equation (4) below, and the gain β1 of the first drive transistor Mia is given by Equation (5) below.

$$\begin{aligned} I1 &= (\beta 1/2)(|Vgs1| - |Vth1|)^2 \\ &= (\beta 1/2)(|Vg1 - ELVDD| - |Vth1|)^2 \end{aligned} \tag{4}$$

$$\beta 1 = \mu 1 \times (W1/L1) \times Cox1 \tag{5}$$

The second drive current I2 included in Equation (3) above is given by Equation (6) below, and the gain β2 of the second drive transistor M1*b* is given by Equation (7) below.

$$\begin{aligned} I2 &= (\beta 2/2)(|Vgs2| - |Vth2|)^2 \\ &= (\beta 2/2)(|Vg2 - ELVDD| - |Vth2|)^2 \end{aligned} \tag{6}$$

$$\beta 2 = \mu 2 \times (W2/L2) \times Cox2 \tag{7}$$

In Equations (4) and (5) above, Vg1, Vgs1, Vth1, μ1, W1, L1, and Cox1 respectively represent the gate voltage, the gate-source voltage, the threshold, the mobility, the channel width, the channel length, and the gate insulating film capacitance per unit area of the first drive transistor Mia, and in Equations (6) and (7) above, Vg2, Vgs2, Vth2, μ2, W2, L2, and Cox2 respectively represent the gate voltage, the gate-source voltage, the threshold, the mobility, the channel width, the channel length, and the gate insulating film capacitance per unit area of the second drive transistor M1*b*.

As is clear from the above-described configuration of the pixel circuit 15 according to the present embodiment (see FIG. 3), since Vg1=Vg2 and Vgs1=Vgs2, it is assumed in the following that Vg=Vg1=Vg2 and Vgs=Vgs1=Vgs2. Further, since the first and second drive transistors Mia, M1*b* are included in the same pixel circuit 15, Vth1=Vth2 can be assumed. Therefore, in the following description, it is assumed that Vth=Vth1=Vth2.

<1.3 Drive and Operation of Pixel Circuit>

Figure 4:
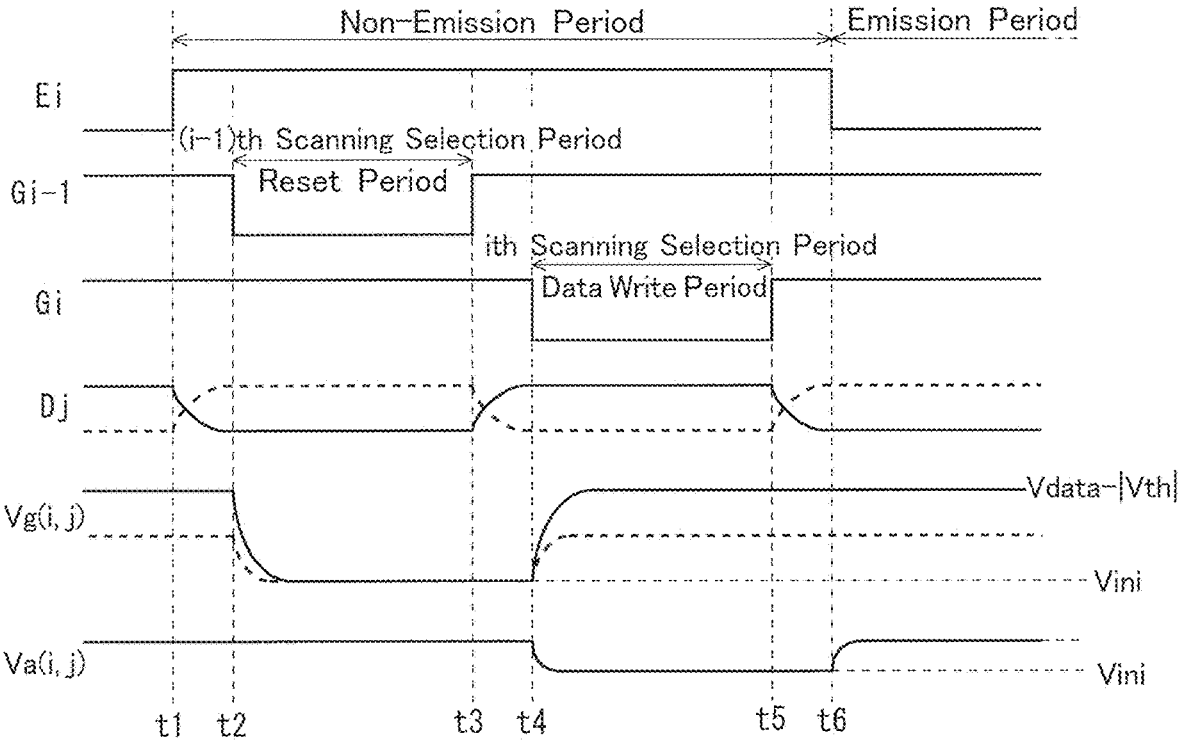
FIG. 4 is a signal waveform diagram for describing the drive and operation of a pixel circuit in an ith row and a jth column in the display device of FIG. 1.
Figure 5:
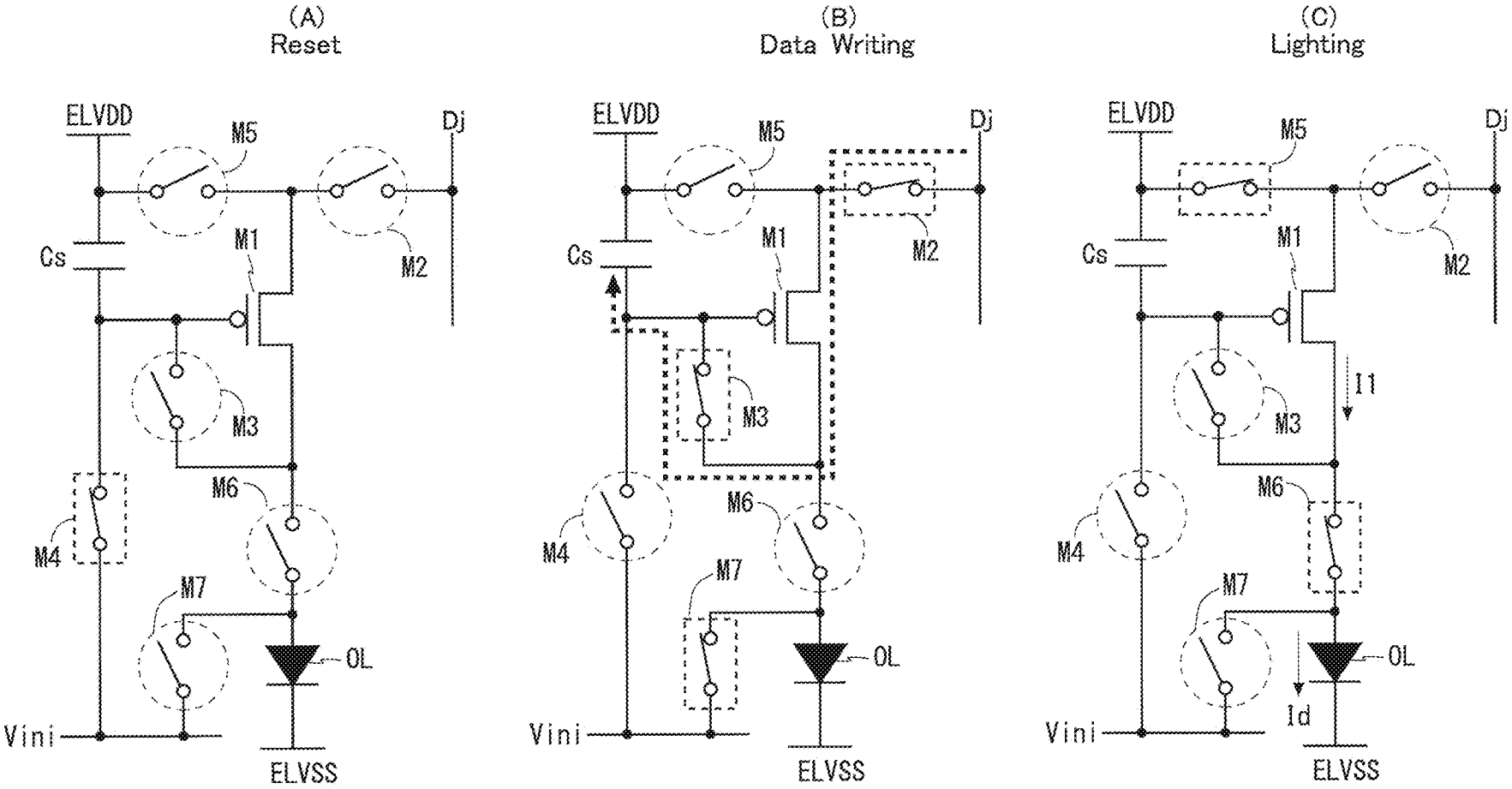
FIG. 5 provides (A) a circuit diagram showing the reset operation of the known pixel circuit, (B) a circuit diagram showing the data writing operation of the pixel circuit, and (C) a circuit diagram showing the lighting operation of the pixel circuit.
Figure 6A:
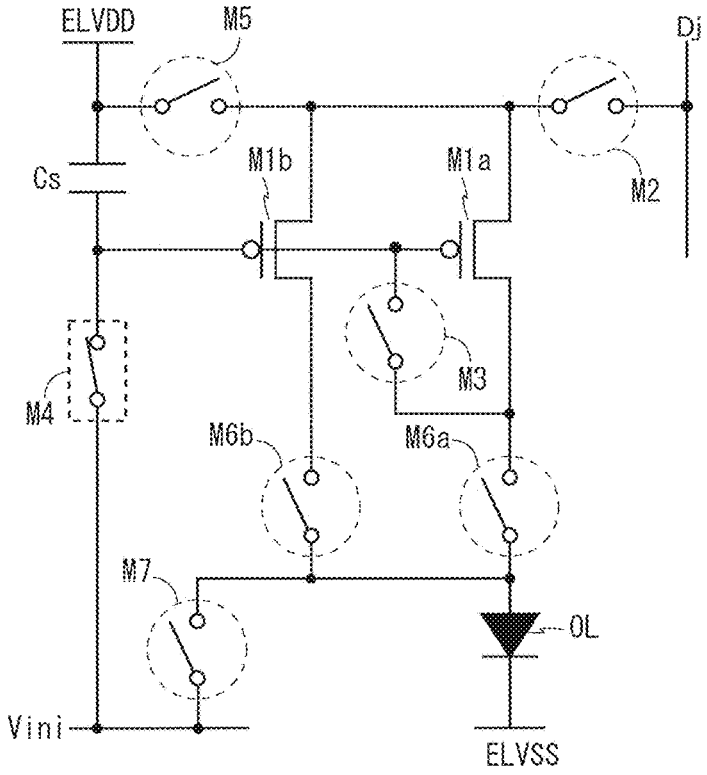
FIG. 6A is a circuit diagram showing the reset operation of the pixel circuit according to the first embodiment.
Figure 6B:
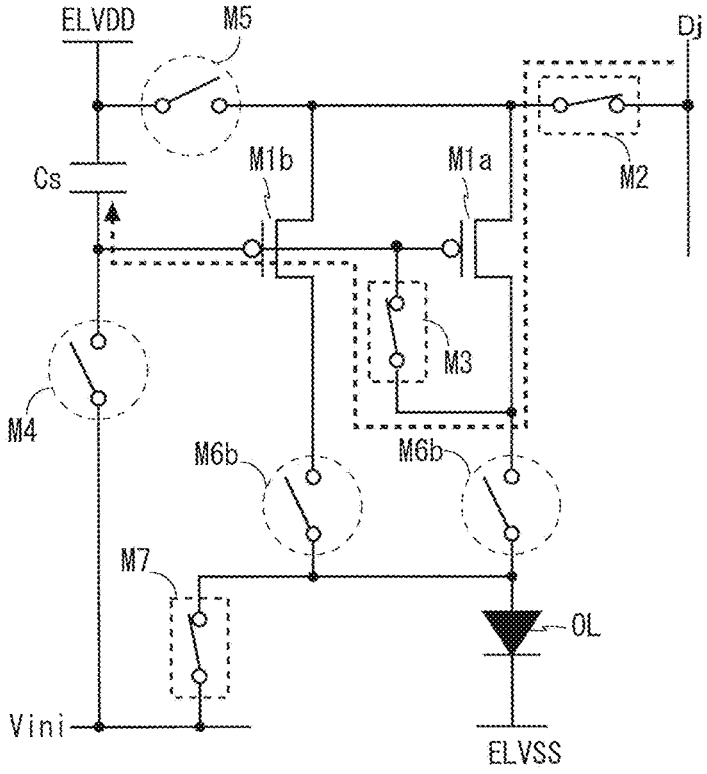
FIG. 6B is a circuit diagram showing the data writing operation of the pixel circuit according to the first embodiment.
Figure 6C:
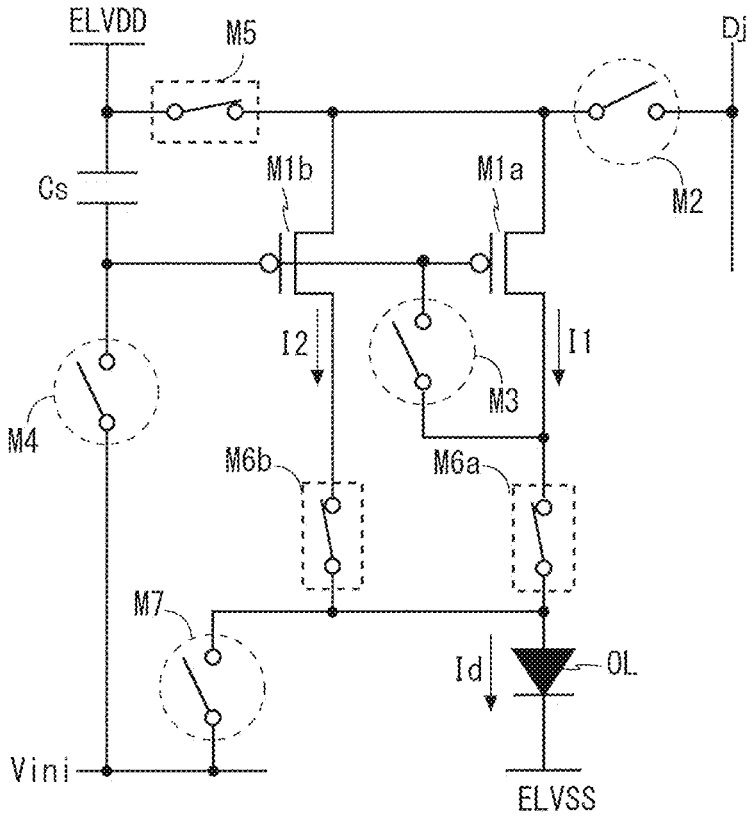
FIG. 6C is a circuit diagram showing the lighting operation of the pixel circuit according to the first embodiment.

FIG. 4 is a signal waveform diagram for describing the drive and operation of the pixel circuit Pix(i,j) in the ith row and the jth column in the display device 10. The pixel circuit Pix(i,j) is periodically driven with a frame period as one cycle, the frame period being made up of a non-emission period that includes a reset period and a data write period and an emission period (display period) during which the organic EL element OL emits light. The method for driving the pixel circuit Pix(i,j) is the same in both a case where the known pixel circuit 14 shown in FIG. 2 is used as the pixel circuit Pix(i,j) and a case where the pixel circuit 15 according to the present embodiment shown in FIG. 3 is used as the pixel circuit Pix(i,j). That is, changes in the voltages of the corresponding emission control line Ei, the preceding scanning signal line Gi−1, the corresponding scanning signal line Gi, and the corresponding data signal line Dj in the reset operation, the data writing operation, and the lighting operation of the pixel circuit Pix(i,j) are the same in the case of using the known pixel circuit 14 and the case of using the pixel circuit 15 according to the present embodiment. Hereinafter, the driving method and operation of the pixel circuit 15 according to the present embodiment will be described together with the driving method and operation of the known pixel circuit 14 with reference to FIG. 5 and FIGS. 6A to 6C together with FIG. 4. Note that (A) of FIG. 5 is a circuit diagram showing the reset operation of the known pixel circuit 14, (B) of FIG. 5 is a circuit diagram showing the data writing operation of the pixel circuit 14, and (C) of FIG. 5 is a circuit diagram showing the lighting operation of the pixel circuit 14. FIG. 6A is a circuit diagram showing the reset operation of the pixel circuit 15 according to the present embodiment, FIG. 6B is a circuit diagram showing the data writing operation of the pixel circuit 15, and FIG. 6C is a circuit diagram showing the lighting operation of the pixel circuit 15.

FIG. 4 shows changes in the voltages of the respective signal lines (corresponding emission control line Ei, preceding scanning signal line Gi−1, corresponding scanning signal line Gi, corresponding data signal line Dj), the voltage (gate voltage) Vg of the gate terminal of the drive transistor Mix, and the voltage (hereinafter referred to as "anode voltage") Va of the anode electrode of the organic EL element OL in the reset operation, the data writing operation, and the lighting operation of the pixel circuit Pix(i,j) in the ith row and the jth column in the display device 10. Here, the "drive transistor Mix" means the drive transistor M1 shown in FIG. 2 when the pixel circuit Pix(i,j) is the known pixel circuit 14, and means the first and second drive transistors Mia, M1*b* shown in FIG. 3 when the pixel circuit Pix(i,j) is the pixel circuit 15 according to the present embodiment (the same applies hereinafter). Therefore, the gate voltage Vg is the gate voltage Vg of the drive transistor M1 shown in FIG. 2 when the pixel circuit Pix(i,j) is the known pixel circuit 14, and the gate voltage Vg=Vg1=Vg2 of the first and second drive transistors Mia, M1*b* shown in FIG. 3 when the pixel circuit Pix(i,j) is the pixel circuit 15 according to the present embodiment.

In FIG. 4, a period from time t1 to time t6 is a non-emission period for the pixel circuits Pix(i, 1) to Pix(i,m) in the ith row. A period from time t2 to t4 is an (i−1)th horizontal period, and a period from time t2 to t3 is a selection period for the (i−1)th scanning signal line (preceding scanning signal line) Gi−1, that is, an (i−1)th scanning selection period. The (i−1)th scanning selection period corresponds to a reset period for the pixel circuits Pix(i, 1) to Pix(i,m) in the ith row. A period from time t4 to time t6 is an ith horizontal period, and a period from time t4 to time t5 is a selection period for the ith scanning signal line (corresponding scanning signal line) Gi, that is, an ith scanning selection period. The ith scanning selection period corresponds to a data write period for the pixel circuits Pix(i, 1) to Pix(i,m) in the ith row.

In the pixel circuit Pix(i,j) in the ith row and the jth column, when the voltage of the emission control line Ei changes from L level to H level at time t1 as shown in FIG. 4, the power supply transistor M5 and the emission control transistor M6*x* change from an on-state to an off-state, and the organic EL element OL comes into a non-emission state. Here, the "emission control transistor M6*x*" means the emission control transistor M6 shown in FIG. 2 when the pixel circuit Pix(i,j) is the known pixel circuit 14, and means the first and second emission control transistors M6*a*, M6*b* shown in FIG. 3 when the pixel circuit Pix(i,j) is the pixel circuit 15 according to the present embodiment (the same applies hereinafter). Therefore, in the latter case, when the voltage of the emission control line Ei changes from L level to H level, both the first and second emission control transistors M6*a*, M6*b* shown in FIG. 3 change from the on-state to the off-state.

At time t2, the voltage of the preceding scanning signal line Gi−1 changes from H level to L level, so that the preceding scanning signal line Gi−1 comes into a selected state. Hence, the first initialization transistor M4 changes to the on-state. Thereby, the gate voltage Vg of the drive transistor Mix is initialized to the initialization voltage Vini. The initialization voltage Vini is such a voltage that the drive transistor Mix can be maintained in the on-state at the time of writing the data voltage to the pixel circuit Pix(i,j). Note that symbol "Va(i,j)" is used in a case where the anode voltage Va in the pixel circuit Pix(i,j) is distinguished from the anode voltage Va in another pixel circuit (the same applies hereinafter).

A period from time t2 to time t3 is a reset period in the pixel circuits Pix(i, 1) to Pix(i,m) in the ith row, and during the reset period, the first initialization transistor M4 is in the on-state in the pixel circuit Pix(i,j), as described above. When the pixel circuit Pix(i,j) is the known pixel circuit 14, (A) of FIG. 5 schematically shows a state of the pixel circuit Pix(i,j) during the reset period, that is, a circuit state during a reset operation. In (A) of FIG. 5, a dotted circle indicates that a transistor as a switching element therein is in the off-state, and a dotted rectangle indicates that a transistor as a switching element therein is in the on-state (such a representation method is also adopted in (B) and (C) of FIG. 5, FIGS. 6A to 6C, and FIGS. 11 and 12.). When the pixel circuit Pix(i,j) is the pixel circuit 15 according to the present embodiment, FIG. 6A schematically shows a state of the pixel circuit Pix(i,j) during the reset period, that is, a circuit state during a reset operation. During the reset period, as shown in (A) of FIG. 5 and FIG. 6A, the first initialization transistor M4 is in the on-state. FIG. 4 shows a change in the gate voltage Vg(i,j) of the pixel circuit Pix(i,j) at this time. Note that symbol "Vg(i,j)" is used in a case where the gate voltage Vg in the pixel circuit Pix(i,j) is distinguished from the gate voltage Vg in another pixel circuit (the same applies hereinafter).

At time t3, the voltage of the preceding scanning signal line Gi−1 changes to H level, so that the preceding scanning signal line Gi−1 comes into a non-selected state. Hence, the first initialization transistor M4 changes to the off-state. During a period from time t3 to the start time point t4 of the ith scanning selection period, the data-side drive circuit 30 starts to apply the data signal D(j) as the data voltage of the pixel in the ith row and jth column to the data signal line Dj and continues to apply the data signal D(j) at least until the end time point t5 of the ith scanning selection period.

At time t4, as shown in FIG. 4, the voltage of the corresponding scanning signal line Gi changes from H level to L level, so that the corresponding scanning signal line Gi comes into the selected state. Thus, in the pixel circuit Pix(i,j), the writing control transistor M2 and the threshold compensation transistor M3 change to the on-state.

A period from time t4 to time t5 is a data write period in the pixel circuits Pix(i, 1) to Pix(i,m) in the ith row, and during the data write period, as described above, the writing control transistor M2 and the threshold compensation transistor M3 are in the on-state. When the pixel circuit Pix(i,j) is the known pixel circuit 14, (B) of FIG. 5 schematically shows a state of the pixel circuit Pix(i,j) during the data write period, that is, a circuit state during the data writing operation. In this case, during the data write period, the voltage of the corresponding data signal line Dj is supplied as the data voltage Vdata to the holding capacitor Cs via the drive transistor M1 in the diode connection mode. As a result, as shown in FIG. 4, the gate voltage Vg(i,j) changes toward a value given by Equation (8) below.

$$Vg(i,j)=\mathrm{Vdata}-|Vth| \tag{8}$$

That is, during the data write period, the data voltage subjected to threshold compensation is written to the holding capacitor Cs, and the gate voltage Vg(i,j) becomes the value given by Equation (8) above. When the pixel circuit Pix(i,j) is the pixel circuit 15 according to the present embodiment, FIG. 6B schematically shows a state of the pixel circuit Pix(i,j) during the data write period, that is, a circuit state during a data writing operation. In this case, during the data write period, the voltage of the corresponding data signal line Dj is supplied as the data voltage Vdata to the holding capacitor Cs via the first drive transistor M1*a* in the diode connection mode. As a result, as shown in FIG. 4, the gate voltage Vg(i,j) changes toward a value given by Equation (8) above. In this case, no current flows between the source and the drain of the second drive transistor M1*b* during the data write period.

When the corresponding scanning signal line Gi comes into the selected state at time t4, the second initialization transistor M7 also changes to the on-state. Thereby, the accumulated charge in the parasitic capacitance of the organic EL element OL is released, and the anode voltage Va of the organic EL element OL is initialized to the initialization voltage Vini (see FIG. 4).

Thereafter, at time t6, the voltage of the emission control line Ei changes to L level. Accordingly, the power supply transistor M5 and the emission control transistor M6*x* (the emission control transistor M6 when the pixel circuit Pix(i,j) is the known pixel circuit 14, and the first and second emission control transistors M6*a*, M6*b* when the pixel circuit Pix(i,j) is the pixel circuit 15 according to the present embodiment) change to the on-state. A period after time t6 is an emission period, and during the emission period, in the pixel circuit Pix(i,j), the power supply transistor M5 and the emission control transistor M6*x* are in the on-state as described above, and the writing control transistor M2, the threshold compensation transistor M3, the first initialization transistor M4, and the second initialization transistor M7 are in the off-state.

When the pixel circuit Pix(i,j) is the known pixel circuit 14, (C) of FIG. 5 schematically shows a state of the pixel circuit Pix(i,j) during the emission period, that is, a circuit state during a lighting operation. In this case, during the emission period (after time t6), the current I1 flows from the high-level power line ELVDD to the low-level power line ELVSS via the power supply transistor M5, the drive transistor M1, the emission control transistor M6, and the organic EL element OL. The current I1 is given by Equation (1) above. Considering that the drive transistor M1 is of the P-channel type and ELVDD>Vg, the current I1 is given by Equations (1) and (8) above.

$$\begin{aligned} I1 &= (\beta/2)(ELVDD - Vg - |Vth|)^2 \\ &= (\beta/2)(ELVDD - Vdata)^2 \end{aligned}$$

The current I1 represented by the above equation flows through the organic EL element OL as the drive current Id. That is, the drive current Id of the organic EL element OL is given by the following equation.

$$Id=I1=(\mu/2)(\mathrm{ELVDD}-\mathrm{Vdata})^2 \tag{9}$$

Therefore, after time t6, regardless of the threshold Vth of the drive transistor M1, the drive current Id corresponding to the data voltage Vdata, which is the voltage of the corresponding data signal line Dj during the ith scanning selection period, flows through the organic EL element OL, whereby the organic EL element OL emits light with luminance corresponding to the data voltage Vdata.

When the pixel circuit Pix(i,j) is the pixel circuit 15 according to the present embodiment, FIG. 6C schematically shows a state of the pixel circuit Pix(i,j) during the emission period, that is, a circuit state during a lighting operation. In this case, during the emission period (after time t6), the first drive current I1 flows from the high-level power line ELVDD to the low-level power line ELVSS via the power supply transistor M5, the first drive transistor M1*a*, the first emission control transistor M6*a*, and the organic EL element OL, and the second drive current I2 flows from the high-level power line ELVDD to the low-level power line ELVSS via the power supply transistor M5, the second drive transistor M1*b*, the second emission control transistor M6*b*, and the organic EL element OL. The first and second drive currents I1, I2 are given by Equations (4) and (6) above, respectively. Considering that the first and second drive transistors M1*a*, M1*b* are of the P-channel type, ELVDD>Vg=Vg1=Vg2, and Vth=Vth1=Vth2 can be assumed as described above, the first drive current I1 is given by Equation (10) below from Equations (4) and (8) above, and the second drive current I2 is given by Equation (11) below from Equations (6) and (8) above.

$$\begin{aligned} I1 &= (\beta 1/2)(ELVDD - Vg - |Vth|)^2 \\ &= (\beta 1/2)(ELVDD - Vdata)^2 \end{aligned} \tag{10}$$

$$\begin{aligned} I2 &= (\beta 2/2)(ELVDD - Vg - |Vth|)^2 \\ &= (\beta 2/2)(ELVDD - Vdata)^2 \end{aligned} \tag{11}$$

From these Equations (10) and (11) and Equation (3), the drive current Id flowing through the organic EL element OL is given by the following Equation.

$$Id = I1 + I2 \tag{12}$$
$$= \{(\beta 1 + \beta 2)/2\}(ELVDD - Vdata)^2$$

Thus, in also the case where the pixel circuit Pix(i,j) is the pixel circuit 15 corresponding to the present embodiment (FIG. 3), after time t6, regardless of the threshold Vth (=Vth1=Vth2) of the first and second drive transistors M1*a*, M1*b*, the drive current Id corresponding to the data voltage Vdata, which is the voltage of the corresponding data signal line Dj during the ith scanning selection period, flows through the organic EL element OL, whereby the organic EL element OL emits light with luminance corresponding to the data voltage Vdata.

In the display device using the pixel circuit configured to initialize the gate voltage of the drive transistor and then write the data voltage to the holding capacitor via the drive transistor in the diode connection mode as in the known pixel circuit 14 and the pixel circuit 15 according to the present embodiment, normally, each pixel circuit is controlled so that the organic EL element is not turned on not only in the data write period (the ith scanning selection period shown in FIG. 4) but also in at least the reset period (the (i−1)th scanning selection period shown in FIG. 4) therebefore, and the organic EL element is in the non-emission state during at least both periods.

<1.4 Layout Pattern>

Figure 7:
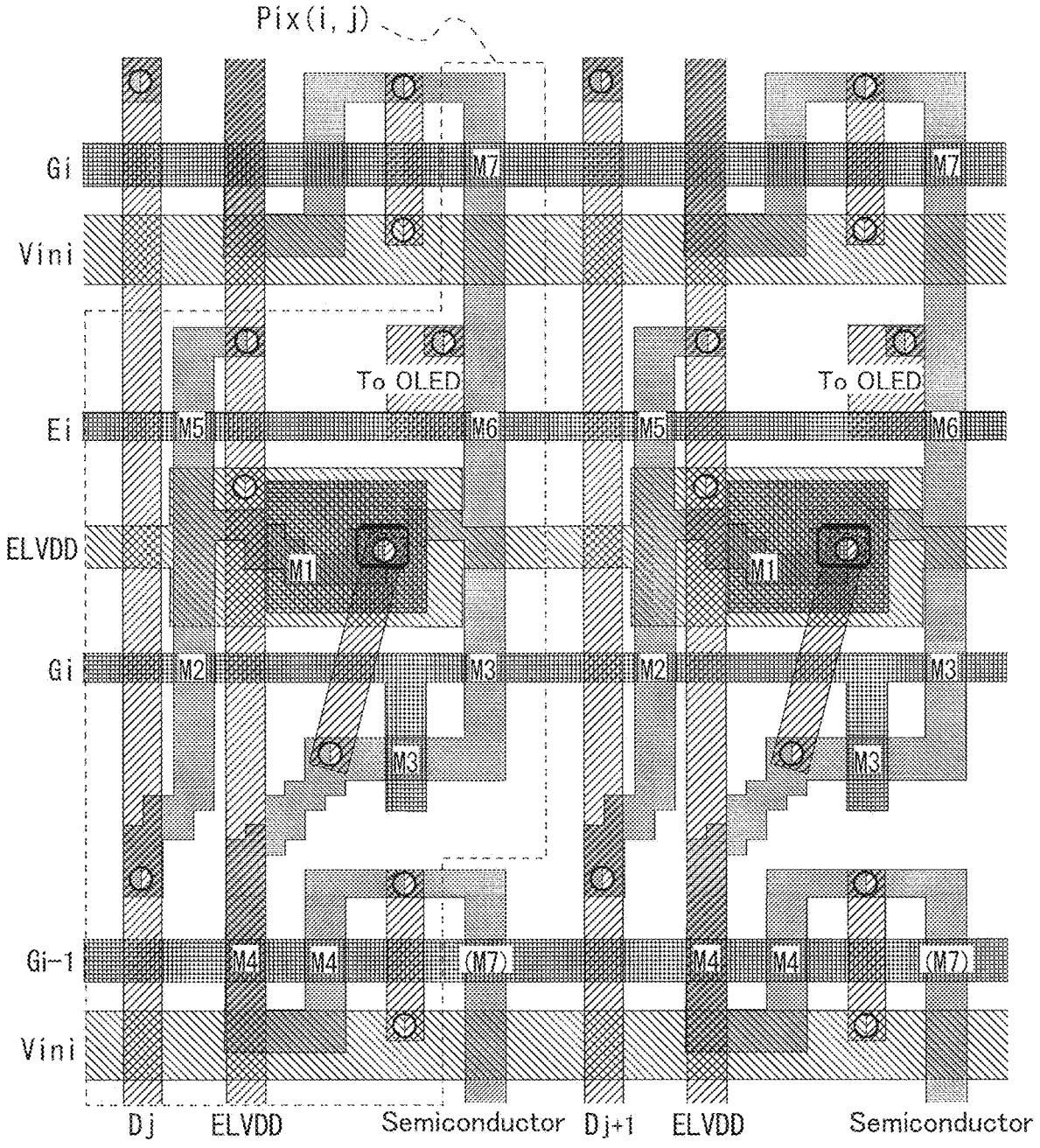
FIG. 7 is a diagram for describing the layout pattern of the known pixel circuit.
Figure 8:
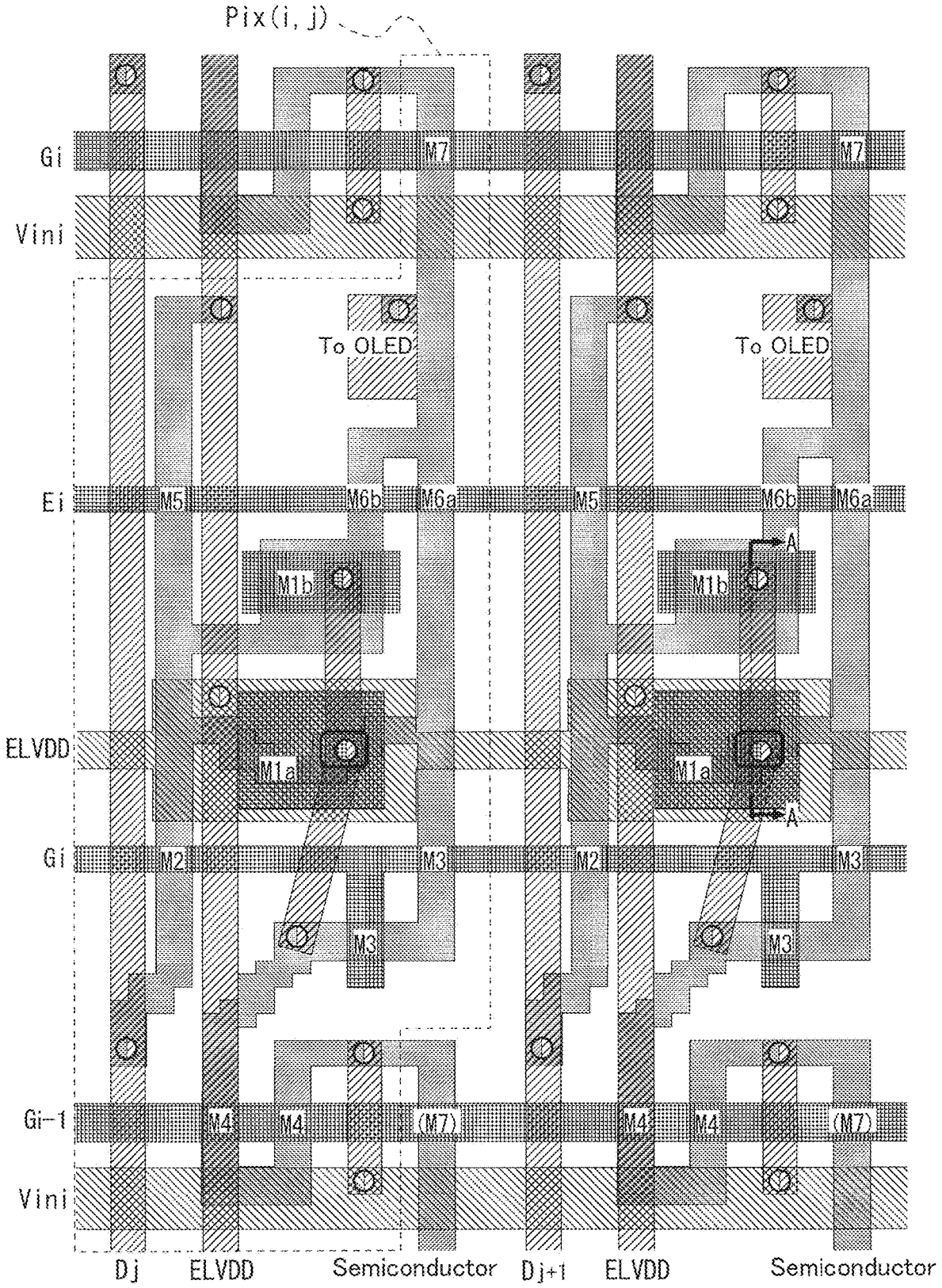
FIG. 8 is a diagram for describing the layout pattern of the pixel circuit according to the first embodiment.

Hereinafter, a layout pattern for forming the pixel circuit 15 according to the present embodiment (FIG. 3) (hereinafter referred to as "the layout pattern of the pixel circuit") will be described with reference to FIGS. 7 and 8. In FIGS. 7 and 8, a pattern hatched with oblique lines extending in the column direction (the vertical direction in the drawing) indicates a wiring pattern (a wiring pattern such as the data signal line Dj) formed of a metal material in a certain layer, a pattern hatched with oblique lines extending in the row direction (the horizontal direction in the drawing) indicates a wiring pattern (a wiring pattern such as the initialization voltage supply line Vini) formed of a metal material in another layer, a pattern hatched with a lattice extending in the row direction indicates a wiring pattern (a wiring pattern of a gate line as a scanning signal line) formed of a metal material in still another layer, and a pattern hatched with dots indicates a wiring pattern formed of a semiconductor material in still another layer (see FIG. 9 to be described later). A circle made up of two semicircles hatched differently from each other indicates a contact hole, and hatching attached to each of the two semicircles indicates that a wiring pattern indicated by the hatching of one semicircle and a wiring pattern indicated by the hatching of the other semicircle are electrically connected by the contact hole. Note that the representation method regarding the layout pattern is also employed in other embodiments to be described later (see FIGS. 13 and 15 to be described later.).

<1.4.1 Layout Pattern of Known Pixel Circuit>

Before the description of the layout pattern of the pixel circuit according to the present embodiment, the layout pattern of the known pixel circuit 14 will be described as a comparative example.

FIG. 7 is a diagram for describing the layout pattern of the known pixel circuit 14 shown in FIG. 2. In FIG. 7, a part of the layout pattern of the plurality of pixel circuits formed in a matrix in the display portion 11 (a part corresponding to two pixel circuits) is drawn, and a portion surrounded by a dotted line is the layout pattern of the pixel circuit Pix(i,j) in the ith row and the jth column. As described above, the display portion 11 is provided with m×n pixel circuits Pix(1, 1) to Pix(n,m) arranged in a matrix along the m data signal lines D1 to Dm and the n scanning signal lines G1 to Gn, and the pixel circuit Pix(i,j) in the ith row and the jth column corresponds to the ith scanning signal line Gi and the jth data signal line Dj. As can be seen from the layout pattern shown in FIG. 7, in the pixel circuit Pix(i,j) formed by the layout pattern and the display portion 11, one scanning signal line Gi is implemented by two wiring patterns, and the threshold compensation transistor M3 and the first initialization transistor M4 are of a dual gate type in order to reduce an off-leakage current (the same applies to the present embodiment and other embodiments described later.).

In the pixel circuit 14 as described above, in the case of increasing the display luminance while maintaining the drive voltage, a channel width W of the drive transistor M1 is set to a value larger than a normal value of about 100 μm to 120 μm. Hereinafter, the channel width W of the drive transistor M1 in the pixel circuit 14 is assumed to be 120 μm.

<1.4.2 Layout Pattern of Pixel Circuit According to Present Embodiment>

FIG. 8 is a diagram for describing the layout patter of the pixel circuit 15 according to the present embodiment shown in FIG. 3. In FIG. 8 as well, a part corresponding to two pixel circuits in the layout pattern of the m×n pixel circuits Pix(1, 1) to Pix(n,m) formed in a matrix in the display portion 11 is drawn, and a portion surrounded by a dotted line is the layout pattern of the pixel circuit Pix(i,j) in the ith row and the jth column corresponding to the ith scanning signal line Gi and the jth data signal line Dj among the m×n pixel circuits Pix(1, 1) to Pix(n,m).

As shown in FIG. 8, the layout pattern of the pixel circuit Pix(i,j) in the ith row and the jth column, which is the pixel circuit 15 according to the present embodiment, includes the layout pattern for forming the first and second drive transistors M1*a*, M1*b* described above for driving the organic EL element (OLED) OL and is different in this respect from the layout pattern (see FIG. 7) of the pixel circuit Pix(i,j) in the ith row and the jth column, which is the known pixel circuit 14. The pixel circuit 15 according to the present embodiment is configured such that only the first drive transistor M1*a* of the first and second drive transistors M1*a*, M1*b* is set in the diode connection mode by the threshold compensation transistor M3 during the data write period (see FIGS. 3 and 6B), and accordingly, the pixel circuit 15 includes the first and second emission control transistors M6*a*, M6*b* connected in series to the first and second drive transistors M1*a*, M1*b*, respectively. Therefore, the layout pattern of the pixel circuit Pix(i,j) in the ith row and the jth column shown in FIG. 8 includes a layout pattern for forming the two emission control transistors M6*a*, M6*b*, and is different in this respect as well from the layout pattern (see FIG. 7) of the pixel circuit Pix(i,j) in the ith row and the jth column, which is the known pixel circuit 14.

In the pixel circuit 15 having the layout pattern as described above, in the case of increasing the display luminance while maintaining the drive voltage, for example, the channel width W1 of the first drive transistor M1*a* is set to a value of about 3 μm to 10 μm, and the second drive transistor M1*b* is set to a value of about 100 μm to 120 μm. As a result, display luminance similar to that in a case where the channel width W of the drive transistor M1 is set to 100

μm to 120 μm in the known pixel circuit 14 can be obtained. By setting the channel width W1 of the first drive transistor Mia to be relatively small in this manner, the accuracy in threshold compensation can be maintained without increasing the capacitance value of the holding capacitor Cs. Hereinafter, the channel width W1 of the first drive transistor Mia and the channel width W2 of the second drive transistor M1*b* in the pixel circuit 15 are assumed to be 10 μm and 110 μm, respectively. For sufficiently increasing the display luminance while maintaining the drive voltage, it is preferable to set the channel width W2 of the second drive transistor M1*b* not involved in the threshold compensation operation to a value larger than the channel width W1 of the first drive transistor M1*a* while setting the channel width W1 of the first drive transistor M1*a* to a relatively small value.

Figure 9:
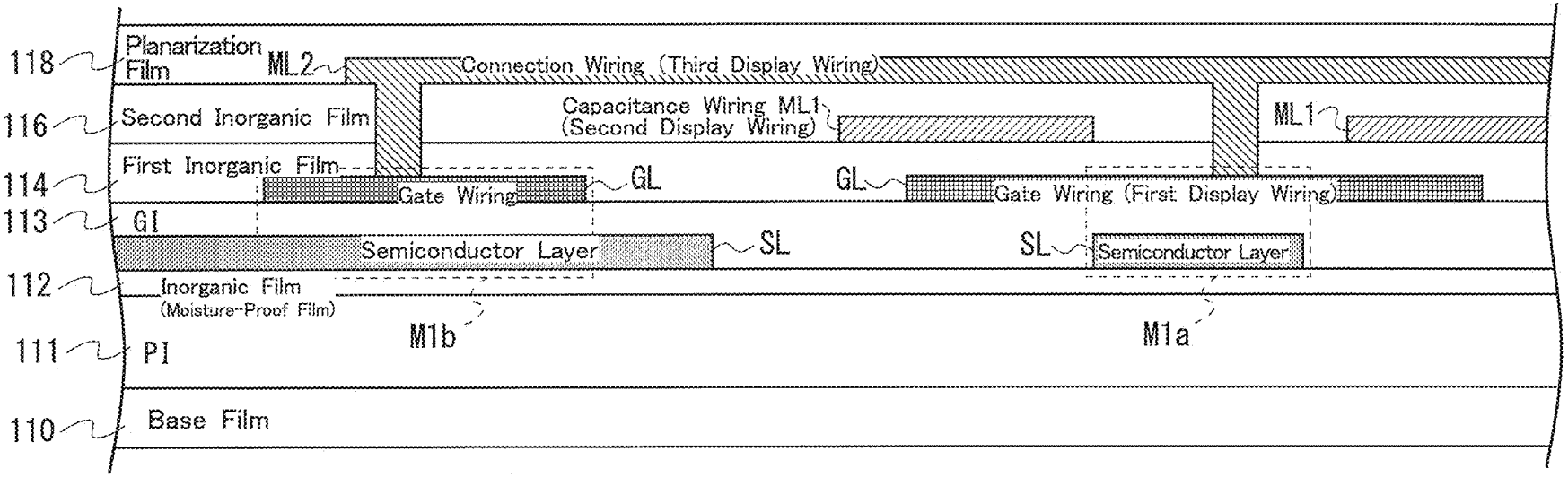
FIG. 9 is a cross-sectional view taken along line A-A in FIG. 8.

FIG. 9 is a cross-sectional view taken along line A-A in FIG. 8 and shows a configuration example of a cross-sectional structure of the first and second drive transistors M1*a*, M1*b* included in the pixel circuit 15 according to the present embodiment. As shown in FIG. 9, in the display portion 11 including the pixel circuit 15, a polyimide layer (PI layer) 111 is formed on a base film 110, a semiconductor layer SL is formed on an inorganic insulating film 112 as a moisture-proof layer formed on the PI layer 111, and a gate insulating film (GI layer) 113 is formed to cover the semiconductor layer SL. Gate wiring GL as first display wiring for forming a gate electrode is formed on the GI layer 113, and a thin-film transistor is made of the gate wiring GL and the semiconductor layer SL facing the gate wiring GL via the GI layer 113. A portion of the semiconductor layer SL facing the gate wiring GL functions as the channel region of the thin-film transistor, and a portion of the GI layer 113 and the gate wiring GL corresponding to the channel region constitutes the gate portion of the thin-film transistor. In the configuration example shown in FIG. 9, the first and second drive transistors M1*a*, M1*b* are fabricated in this manner. A first inorganic insulating film 114 is formed to cover the gate wiring GL, metal wiring ML1 including capacitance wiring is formed thereon as second display wiring, and a second inorganic insulating film 116 is formed to cover the second display wiring. The metal wiring ML1, which is the capacitance wiring, and the gate wiring GL corresponding to the gate terminal of the first drive transistor M1*a* are disposed to face each other with an insulating film interposed therebetween, thereby forming the holding capacitor Cs. Furthermore, metal wiring ML2 including connection wiring for electrical connection with another element is formed as third display wiring on the second inorganic insulating film 116. An insulating layer 118 as a planarization film is formed on the second inorganic insulating film 116 so as to cover the metal wiring ML2. As shown in FIG. 9, the gate wiring GL corresponding to the gate terminal of the first drive transistor M1*a* and the gate wiring GL corresponding to the gate terminal of the second drive transistor M1*b* are electrically connected to each other through contact holes and connection wiring (metal wiring) ML2 provided in the first inorganic insulating film 114 and the second inorganic insulating film 116. As can be seen from FIGS. 8 and 9, the capacitance wiring (metal wiring) ML1 corresponding to the electrode constituting the holding capacitor Cs is formed to overlap the first drive transistor M1*a*.

<1.5 Effects>

As described above, in the pixel circuit 15 according to the present embodiment, unlike the known pixel circuit 14 (FIG. 2), the first and second drive transistors M1*a*, M1*b* are provided in order to supply the drive current Id to the organic EL element OL as a display element (see FIG. 3), and only the first drive transistor M1*a* is set in the diode connection mode by the threshold compensation transistor M3 during the data write period (see FIGS. 4 and 6B). Unlike the known pixel circuit 14 (FIG. 2), the pixel circuit 15 includes first and second emission control transistors M6*a*, M6*b* connected in series to the first and second drive transistors M1*a*, M1*b*, respectively. Thereby, the pixel circuit 15 is configured such that the holding capacitor Cs is charged only with the current flowing through the first drive transistor M1*a* and the current does not flow through the second drive transistor M1*b* in the data write period during which the threshold compensation operation is performed (see FIG. 6B). Hence, the data voltage corrected to compensate for the threshold Vth1 of the first drive transistor M1*a* can be accurately written to the holding capacitor Cs without increasing the capacitance value of the holding capacitor Cs. As described above, the first and second drive transistors M1*a*, M1*b* are included in the same pixel circuit 15 and are close to each other, so that the thresholds of the first and second drive transistors M1*a*, M1*b* can be regarded as being equal to each other (Vth1=Vth2). Therefore, during the data write period, not only the threshold Vth1 of the first drive transistor M1*a* but also the threshold Vth2 of the second drive transistor M1*b* are compensated for.

During an emission period (display period) during which the organic EL element OL emits light, as shown in FIG. 6C, the first drive current I1 is supplied from the first drive transistor M1*a* to the organic EL element OL, the second drive current I2 is supplied from the second drive transistor M1*b* to the organic EL element OL, and a current corresponding to the sum of the first drive current I1 and the second drive current I2 flows through the organic EL element OL as the drive current Id (see Equation (3) above).

As described above, in the present embodiment, of the two drive transistors M1*a*, M1*b* provided in the pixel circuit 15, the first drive transistor M1*a* performs the data writing operation accompanied by threshold compensation and the drive of the organic EL element OL, and the second drive transistor M1*b* only performs the drive of the organic EL element OL. As a result, the accuracy in threshold compensation can be maintained without increasing the capacitance value of the holding capacitor Cs, and the display luminance can be improved without increasing the drive voltage.

When the capacitance value of the holding capacitor Cs is increased in order to improve the display luminance while maintaining the accuracy in threshold compensation in the known pixel circuit 14, the following problems occur regarding the display quality and the yield during manufacturing. That is, the charge for initializing the holding capacitor Cs cannot be sufficiently performed during the reset period (see FIG. 4 and (A) of FIG. 5), thus causing deterioration in gradation expressing capability. On the other hand, when transconductance is increased by increasing the channel width of the initialization transistor M4 so as to solve the insufficient charge of the holding capacitor Cs during the reset period, the charge is insufficiently held in the holding capacitor Cs due to the leakage current of the initialization transistor M4 during the emission period (see (C) of FIG. 5), and bright dot abnormality or flicker may occur. In addition, when the capacitance value of the holding capacitor Cs is greatly increased, the element area in the pixel circuit 14 greatly increases, leading to a decrease in yield during manufacturing. In contrast, according to the present embodiment, there is no need to increase the capacitance value of the holding capacitor Cs, thus making it possible to avoid the problems as thus described regarding the display quality and the yield during manufacturing.

2. Second Embodiment

Figure 10:
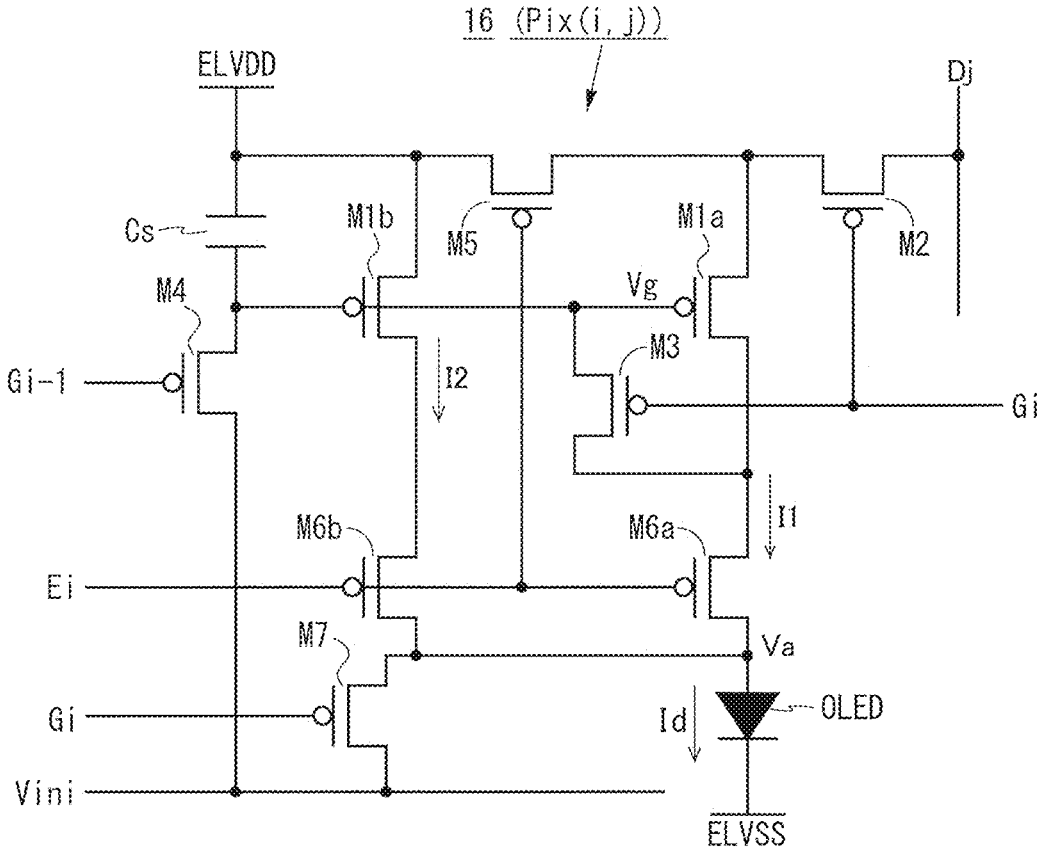
FIG. 10 is a circuit diagram showing a configuration of a pixel circuit according to a second embodiment that can be used in the display device of FIG. 1.

FIG. 10 is a circuit diagram showing a configuration of a pixel circuit 16 according to a second embodiment that can be used as the pixel circuit Pix(i,j) in the display device 10 of FIG. 1.

As shown in FIG. 10, similarly to the pixel circuit (FIG. 3) according to the first embodiment, the pixel circuit 16 includes an organic EL element OL as a display element, first and second drive transistors M1*a*, M1*b*, a writing control transistor M2, a threshold compensation transistor M3, a first initialization transistor M4, a power supply transistor M5, first and second emission control transistors M6*a*, M6*b*, a second initialization transistor M7, and a holding capacitor Cs. In the pixel circuit 16 as well, transistors M2 to M7 except for the first and second drive transistors M1*a*, M1*b* function as switching elements.

In the pixel circuit 15 according to the first embodiment, as shown in FIG. 3, the source terminal of the first drive transistor M1*a* and the source terminal of the second drive transistor M1*b* are directly connected to each other, connected to the corresponding data signal line Dj via the writing control transistor M2, and connected to the high-level power line ELVDD via the power supply transistor M5. In contrast, in the pixel circuit 16 according to the present embodiment, as shown in FIG. 10, the source terminal of the first drive transistor M1*a* and the source terminal of the second drive transistor M1*b* are connected to each other via the power supply transistor M5, and the source terminal of the second drive transistor M1*b* is connected to the corresponding data signal line Dj via the power supply transistor M5 and the writing control transistor M2 in this order and directly connected to the high-level power line ELVDD. Other configurations of the pixel circuit 16 according to the present embodiment are the same as those of the pixel circuit 15 according to the first embodiment, and thus description thereof is omitted. Further, the drive and operation of the pixel circuit 16 according to the present embodiment are also basically the same as those of the pixel circuit 15 according to the first embodiment (see FIGS. 4, 6A to 6C), and thus detailed description thereof is omitted.

The reason why a part of the configuration (connection configuration) of the pixel circuit 16 of the present embodiment is different from that of the pixel circuit 15 according to the first embodiment as described above is to cope with the following problem that occurs when the pixel circuit 15 according to the first embodiment is used.

Figure 11:
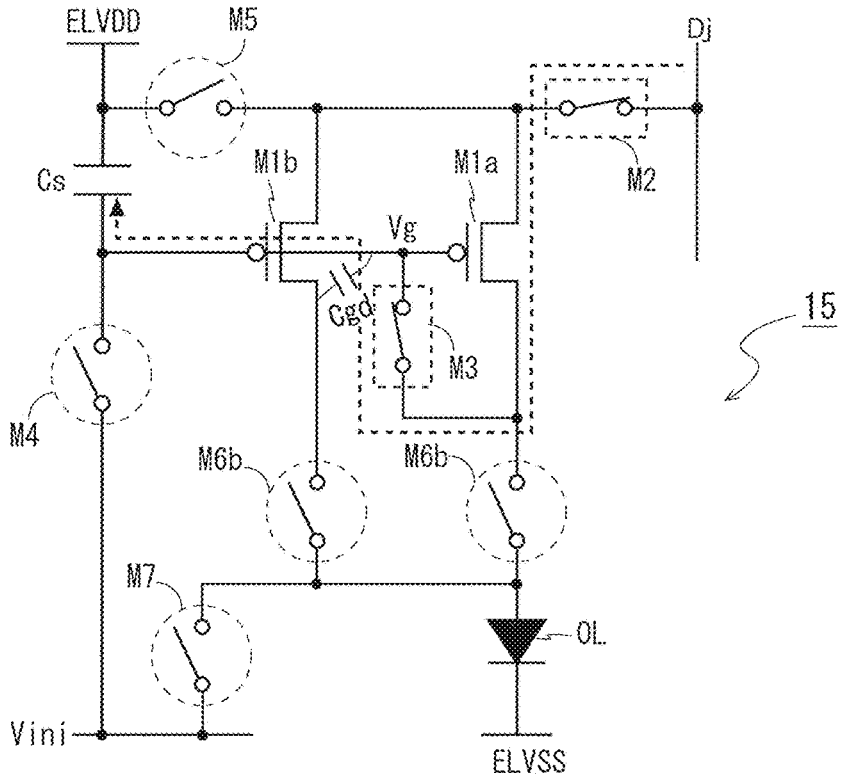
FIG. 11 is a circuit diagram for describing a problem in the data writing operation of the pixel circuit according to the first embodiment.

FIG. 11 schematically shows a state of the pixel circuit 15 according to the first embodiment during the data write period, that is, a circuit state during the data writing operation. As shown in FIG. 11, during the data write period, a current flows into the holding capacitor Cs via the writing control transistor M2 and the first drive transistor M1*a* in the diode connection mode, so that the data voltage corrected for the threshold compensation of the first drive transistor M1*a* is written in the holding capacitor (see Equation (8) described above). At this time, with the second drive transistor M1*b* being not in the off-state, the voltage of the corresponding data signal line Dj, that is, the data voltage Vdata before correction, is also supplied to the drain terminal of the second drive transistor M1*b* via the second drive transistor M1*b*. Thereby the voltage of the drain terminal increases, and this voltage increase affects the gate voltage Vg (the voltage at each of the gate terminals of the first and second drive transistors M1*a*, M1*b*) via a parasitic capacitance Cgd between the gate and the drain of the second drive transistor M1*b*. As a result, the gate voltage Vg may rise to turn off the first drive transistor M1*a*, and the data writing operation accompanied by threshold compensation may stop in the middle. When the data writing operation stops in the middle as thus described, the data voltage is not correctly written in the holding capacitor Cs, and appropriate threshold compensation is not performed, so that gradation display cannot be performed appropriately.

Figure 12:
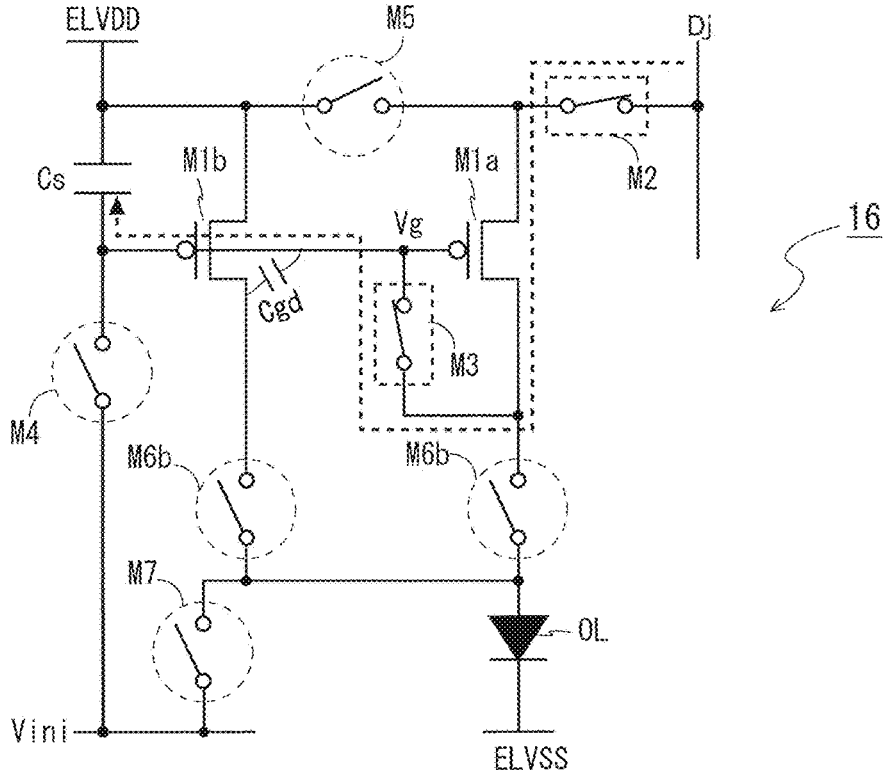
FIG. 12 is a circuit diagram showing the data writing operation of the pixel circuit according to the second embodiment.

FIG. 12 schematically shows a state of the pixel circuit 16 according to the present embodiment during the data write period, that is, a circuit state during the data writing operation. As shown in FIG. 12, in the present embodiment, during the data write period, the power supply transistor M5 between the source terminal of the first drive transistor M1*a* and the source terminal of the second drive transistor M1*b* is in the off-state. Thus, the voltage of the corresponding data signal line Dj, that is, the data voltage Vdata before correction, is not supplied to the second drive transistor M1*b*. The source terminal of the second drive transistor M1*b* is connected to the high-level power line ELVDD, and in the reset period immediately before the data write period (see FIG. 6A), the second drive transistor M1*b* is turned on, and its drain terminal is supplied with the high-level power supply voltage ELVDD, and is maintained at the high-level power supply voltage ELVDD also during the data write period. As thus described, in the present embodiment, the voltage of the drain terminal of the second drive transistor M1*b* remains unchanged, and hence the gate voltage Vg is not affected via the parasitic capacitance Cgd between the gate and the drain of the second drive transistor M1*b*. Therefore, during the data write period, the data writing operation does not stop in the middle, and the data voltage subjected to appropriate correction for threshold compensation is correctly written to the holding capacitor Cs. Therefore, according to the present embodiment, it is possible to obtain the same effects as those of the first embodiment while achieving favorable gradation display by reliably performing appropriate data writing accompanied by threshold compensation in the pixel circuit of the internal compensation type. Since a voltage change that affects the gate voltage Vg does not occur at the drain terminal of the second drive transistor M1*b*, the capacitance value of the holding capacitor Cs can be reduced as compared to the first embodiment.

Figure 13:
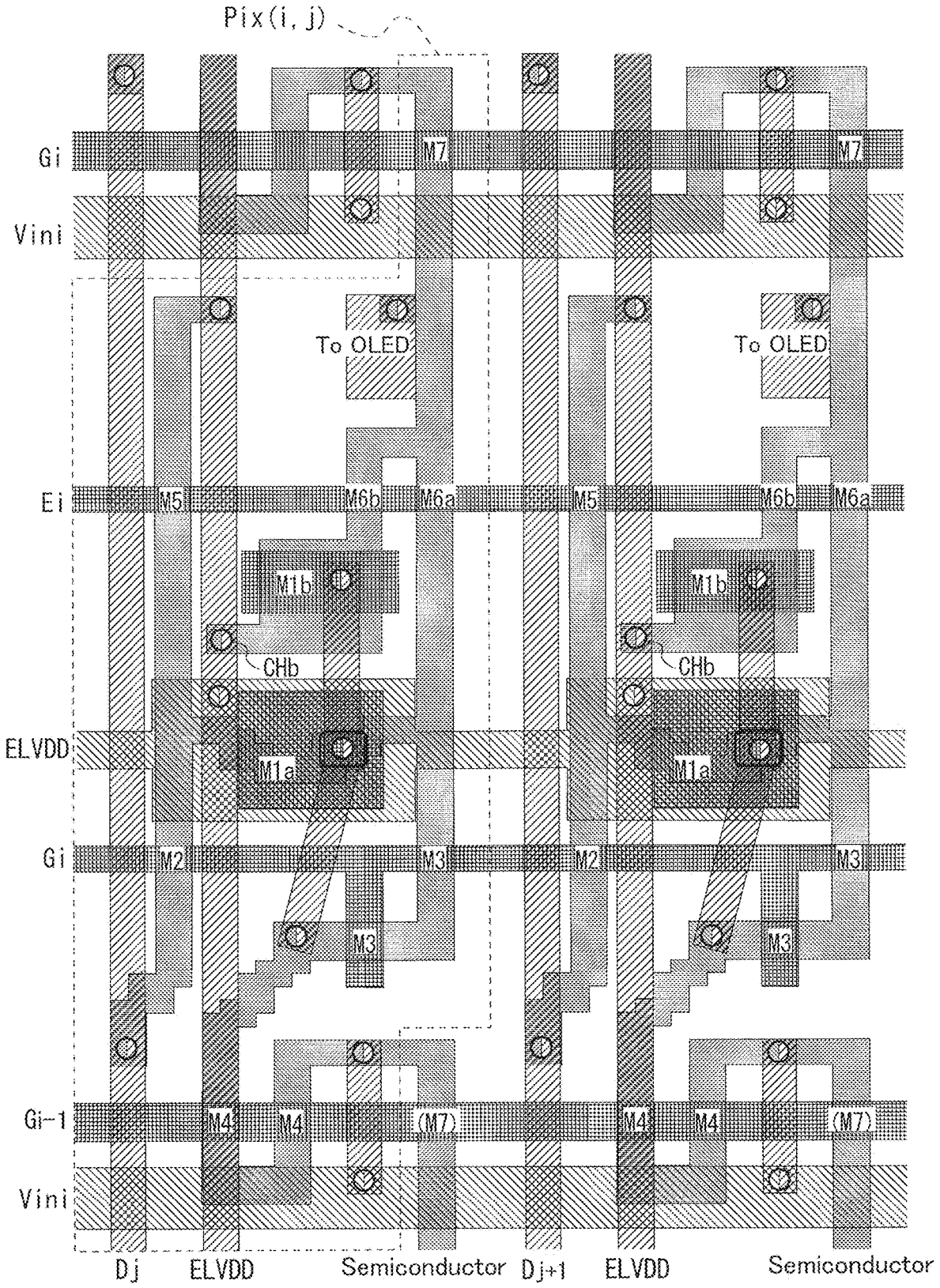
FIG. 13 is a diagram showing the layout pattern of the pixel circuit according to the second embodiment.

FIG. 13 is a diagram for describing a layout pattern of the pixel circuit 16 according to the present embodiment shown in FIG. 10. In FIG. 13 as well, a portion corresponding to two pixel circuits in the layout pattern of the m×n pixel circuits Pix(1, 1) to Pix(n,m) formed in a matrix in the display portion 11 is drawn, and a portion surrounded by a dotted line is the layout pattern of the pixel circuit Pix(i,j) in the ith row and the jth column among the m×n pixel circuits Pix(1, 1) to Pix(n,m).

As shown in FIG. 13, the layout pattern of the pixel circuit 16 (pixel circuit Pix(i,j)) according to the present embodiment also includes a layout pattern for forming the first and second drive transistors M1*a*, M1*b* for driving the organic EL element (OLED) OL, similarly to the layout pattern (see FIG. 8) of the pixel circuit 15 (pixel circuit Pix(i,j)) according to the first embodiment. However, in the layout pattern of the pixel circuit 16 according to the present embodiment, a portion corresponding to the source terminal of the second drive transistor M1*b* is electrically connected to the wiring pattern of the high-level power line ELVDD via the contact hole CHb, and, the layout pattern is different in this respect from the layout pattern of the pixel circuit 15 according to the first embodiment described above (see FIG. 8). As can be seen from FIGS. 8 and 9 together with FIG. 13, such a pixel circuit 16 according to the present embodiment can be fabricated using a layout pattern with an area substantially equal to that of the pixel circuit 15 according to the first embodiment and does not require a manufacturing process different from that of the pixel circuit 15

3. Third Embodiment

The pixel circuit 15 according to the first embodiment includes two drive transistors M1*a*, M1*b*, and of these transistors, the first drive transistor M1*a* performs the data writing operation accompanied by threshold compensation and the drive of the organic EL element OL, and the second drive transistor M1*b* only performs the drive of the organic EL element OL. That is, the pixel circuit 15 includes two drive transistors made up of one compensation-drive transistor M1*a* and one drive-only transistor M1*b*. However, in addition to one compensation-drive transistor, two or more drive-only transistors may be included in the pixel circuit. Therefore, hereinafter, as an example of such a pixel circuit, a pixel circuit including two drive-only transistors in addition to one compensation-drive transistor will be described as a third embodiment.

Figure 14:
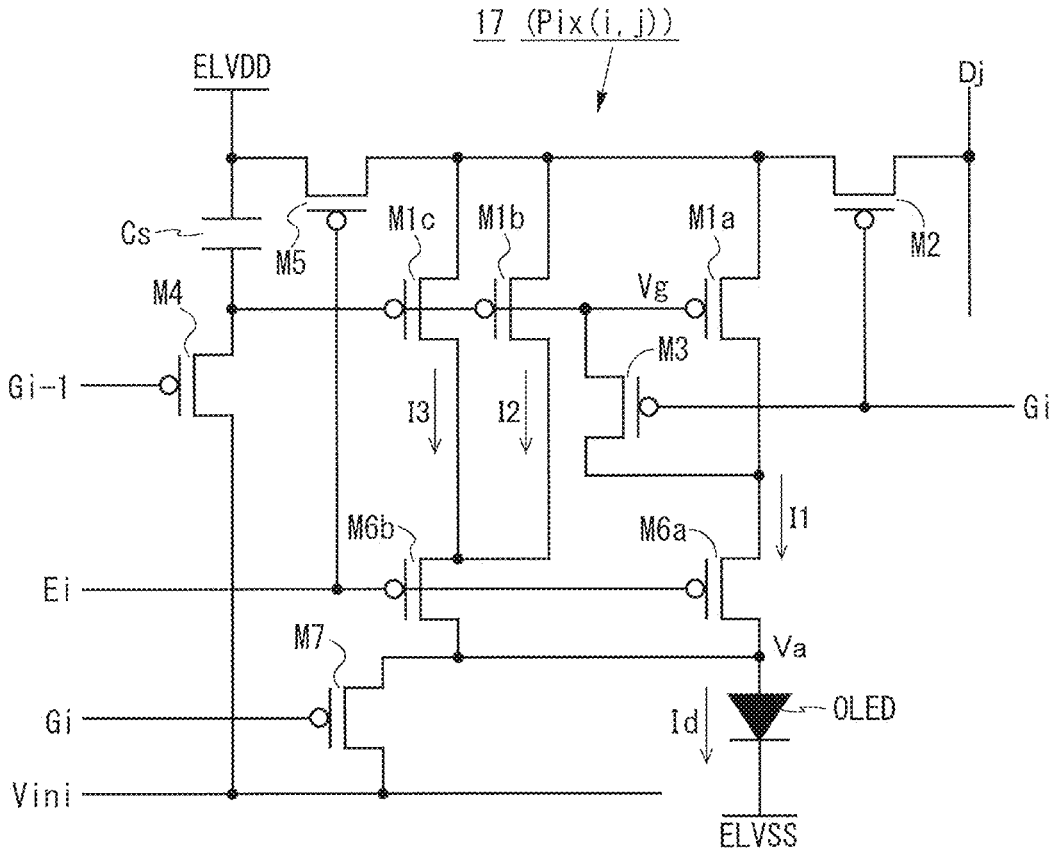
FIG. 14 is a circuit diagram showing a configuration of a pixel circuit according to a third embodiment that can be used in the display device of FIG. 1.

FIG. 14 is a circuit diagram showing a configuration of a pixel circuit 17 according to the third embodiment that can be used as the pixel circuit Pix(i,j) in the display device 10 of FIG. 1.

As shown in FIG. 14, similarly to the pixel circuit (FIG. 3) according to the first embodiment, the pixel circuit 17 includes an organic EL element OL as a display element, first and second drive transistors M1*a*, M1*b*, a writing control transistor M2, a threshold compensation transistor M3, a first initialization transistor M4, a power supply transistor M5, first and second emission control transistors M6*a*, M6*b*, a second initialization transistor M7, and a holding capacitor Cs, and further includes a third drive transistor M1*c*. In the pixel circuit 17 as well, the transistors M2 to M7 except for the first to third drive transistors M1*a*, M1*b*, M1*c* function as switching elements.

In the pixel circuit 17 according to the present embodiment, as shown in FIG. 14, the source terminal and the drain terminal of the third drive transistor M1*c* are connected to the source terminal and the drain terminal of the second drive transistor M1*b*, respectively. That is, the third drive transistor M1*c* is connected in parallel to the second drive transistor M1*b*. The gate terminal of the third drive transistor M1*c* is connected to the gate terminals of the first and second drive transistors M1*a*, M1*b*. Other configurations of the pixel circuit 17 according to the present embodiment are the same as those of the pixel circuit 15 according to the first embodiment, and thus description thereof is omitted. Further, the drive and operation of the pixel circuit 17 according to the present embodiment are also basically the same as those of the pixel circuit 15 according to the first embodiment (see FIGS. 4, 6A to 6C), and thus detailed description thereof is omitted.

As can be seen from FIG. 14, the holding capacitor Cs is shared by the first to third drive transistors M1*a*, M1*b*, M1*c*. Further, the first to third drive transistors M1*a*, M1*b*, M1*c* are included in the same pixel circuit 17 and are close to each other, so that thresholds Vth1, Vth2, Vth3 of the three transistors M1*a*, M1*b*, M1*c* can be regarded as being equal. Therefore, during the data write period, not only the threshold Vth1 of the first drive transistor M1*a* but also the thresholds Vth2, Vth3 of the second and third drive transistors M1*b*, M1*c* are compensated for.

According to the present embodiment, the first drive transistor M1*a* functions as the compensation-drive transistor, and the second and third drive transistors M1*b*, M1*c* function as the drive-only transistor. As a result, the same effects as those of the first embodiment can be obtained, and the drive current Id (=I1+I2+I3) of the organic EL element OL during the emission period can be increased as compared to the first embodiment, thus further increasing the display luminance.

Figure 15:
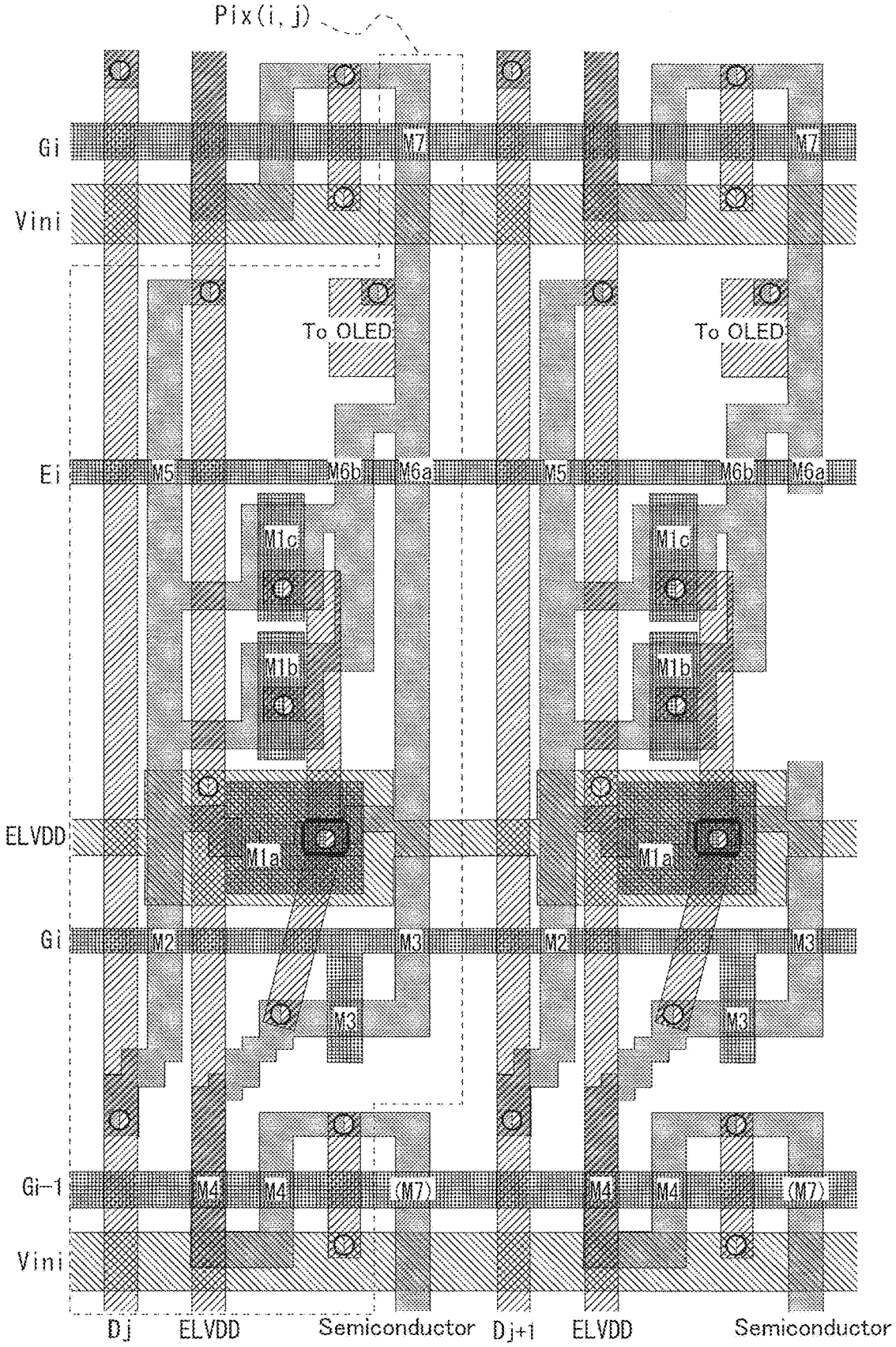
FIG. 15 is a diagram for describing the layout pattern of the pixel circuit according to the third embodiment.

FIG. 15 is a diagram for describing the layout patter of the pixel circuit 17 according to the present embodiment shown in FIG. 14. In FIG. 15 as well, a portion corresponding to two pixel circuits in the layout pattern of the m×n pixel circuits Pix(1, 1) to Pix(n,m) formed in a matrix in the display portion 11 is drawn, and a portion surrounded by a dotted line is the layout pattern of the pixel circuit Pix(i,j) in the ith row and the jth column among the m×n pixel circuits Pix(1, 1) to Pix(n,m).

As shown in FIG. 15, the layout pattern of the pixel circuit 17 (pixel circuit Pix(i,j)) according to the present embodiment includes the layout pattern of the first drive transistor M1*a* as the layout pattern of the compensation-drive transistor, similarly to the layout pattern of the pixel circuit 15 (pixel circuit Pix(i,j)) according to the first embodiment (see FIG. 8). However, the layout pattern of the pixel circuit 17 according to the present embodiment includes the layout pattern of the third drive transistor M1*c* in addition to the layout pattern of the second drive transistor M1*b* as the layout pattern of the drive-only transistor. Although the layout pattern of the second drive transistor M1*b* and the layout pattern of the third drive transistor M1*c* may be different, in the example of FIG. 15, the layout patterns of the second and third drive transistors M1*b*, M1*c* have the same size and the same configuration. Hence channel widths W2, W3 of the second and third drive transistors M1*b*, M1*c* are equal to each other.

With the layout pattern as shown in FIG. 15, it is possible to fabricate the pixel circuit 17 in which higher display luminance can be obtained by driving the organic EL element OL with a larger current while making an increase in the layout area as small as possible. In the pixel circuit 17 according to the layout pattern as shown in FIG. 15, the sizes of the second and third drive transistors M1*b*, M1*c* are the same, and the channel widths W2, W3 thereof are equal to each other, so that it is possible to obtain an advantage that the degrees of deterioration and variation in the characteristics of the second and third drive transistors M1*b*, M1*c* are easily uniform. That is, when transistors of various sizes are connected in parallel to each other as drive transistors, the accuracy in the threshold compensation operation decreases because the degrees of deterioration and variation in the characteristics thereof are uneven. However, when the degrees of deterioration and variation in the characteristics thereof are easily made uniform by making the sizes of the second and third drive transistors M1*b*, M1*c* equal to each other (W2=W3) as described above, such a decrease in the accuracy of the threshold compensation operation can be prevented.

<4. Modifications>

The disclosure is not limited to the above embodiments, and various modifications can be made so long as the modifications do not deviate from the scope of the disclosure.

The pixel circuit 15 according to the first embodiment includes the first drive transistor M1*a* as the compensation-drive transistor and the second drive transistor M1*b* as the drive-only transistor and is configured as shown in FIG. 3, the pixel circuit 16 according to the second embodiment similarly includes the first drive transistor M1*a* and the second drive transistor M1*b* and is configured as shown in FIG. 10, and the pixel circuit 17 according to the third embodiment includes the first drive transistor M1*a* as the compensation-drive transistor and the second and third drive transistors M1*b*, M1*c* as the drive-only transistors and is configured as shown in FIG. 14. However, the disclosure is not limited to these circuit configurations and may be a pixel circuit having another configuration so long as the pixel circuit is configured to include a drive-only transistor not involved in data writing, in addition to a compensation-drive transistor that performs the data writing accompanied by threshold compensation and the drive of the organic EL element OL. Further, although the transistors included in the pixel circuits 15, 16, 17 according to the first to third embodiments are all P-channel transistors, the pixel circuit may be configured using an N-channel transistor.

In the pixel circuit 17 according to the third embodiment, the source terminals of the second and third drive transistors M1*b*, M1*c* as the drive-only transistors are connected to the high-level power line ELVDD via the power supply transistor M5, but instead of this, as in the second embodiment (see FIG. 10), the source terminals may be directly connected to the high-level power line ELVDD, the source terminal of the first drive transistor M1*a* and the source terminals of the second and third drive transistors M1*b*, M1*c* may be connected to each other via the power supply transistor M5, and the source terminals of the second and third drive transistors M1*b*, M1*c* may be connected to the corresponding data signal line Dj via the power supply transistor M5 and the writing control transistor M2 in order. According to such a modification of the third embodiment, it is possible to increase the display luminance as compared to the first and second embodiments while obtaining the same effect as the second embodiment.

In the above, the embodiments and the modifications thereof have been described by taking the organic EL display device as an example, but the disclosure is not limited to the organic EL display device and may be applied to any display device using a display element that is driven by a current. The display element that can be used here is a display element with its luminance, transmittance, and the like, controlled by a current, and for example, an inorganic light-emitting diode, a quantum dot light-emitting diode (QLED), and the like can be used in addition to the organic EL element, that is, the organic light-emitting diode (OLED)).

DESCRIPTION OF REFERENCE CHARACTERS

10: Organic EL Display Device
11: Display Portion
15, 16, 17: Pixel Circuit
Pix(i,j): Pixel Circuit (i=1 to n, j=1 to m)
20: Display Control Circuit
30: Data-Side Drive Circuit (Data Signal Line Drive Circuit)
40: Scanning-Side Drive Circuit (Scanning Signal Line Drive/Emission Control Circuit)
Gi: Scanning Signal Line (i=0 to n)
Ei: Emission Control Line (i=1 to n)
Dj: Data Signal Line (j=1 to m)
Vini: Initialization Voltage Supply Line, Initialization Voltage
ELVDD: High-Level Power Line (First Power Supply Voltage Line), High-Level Power Supply Voltage
ELVSS: Low-Level Power Line (Second Power Supply Voltage Line), Low-Level Power Supply Voltage
OL: Organic EL Element (Display Element)
Cs: Holding Capacitor
M1*a*: First Drive Transistor (Compensation-Drive Transistor)
M1*b*: Second Drive Transistor (Drive-Only Transistor)
M1*c*: Third Drive Transistor (Drive-Only Transistor)
M3: Threshold Compensation Transistor (Threshold Compensation Switching Element)
M4: First Initialization Transistor (Initialization Switching Element)
M5: Power Supply Transistor (Power Supply Switching Element)
M6*a*: First Emission Control Transistor (First Emission Control Switching Element)
M6*b*: Second Emission Control Transistor (Second Emission Control Switching Element)
M7: Second Initialization Transistor
Vg: Gate Voltage

The invention claimed is:

1. A pixel circuit provided to correspond to any one of a plurality of data signal lines and correspond to any one of a plurality of scanning signal lines intersecting the plurality of data signal lines in a display device including a display portion in which the plurality of data signal lines and the plurality of scanning signal lines are arranged, the pixel circuit being driven periodically with a predetermined period, including a data write period and a display period, as one cycle, the pixel circuit comprising:

a display element driven by a current;

a holding capacitor;

first and second drive transistors each configured to supply a current corresponding to a holding voltage of the holding capacitor to the display element during the display period;

a threshold compensation switching element that is connected between a control terminal and a first conduction terminal of the first drive transistor and is turned on during the data write period to set the first drive transistor in a diode connection mode; and first and second emission control switching elements; wherein the pixel circuit is configured such that during the data write period, by supply of a voltage of a corresponding data signal line to the holding capacitor via the first drive transistor in the diode connection mode, a data voltage corrected so as to compensate for a threshold voltage of the first drive transistor is written to the holding capacitor, and such that during the display period, a current flowing through the first drive transistor based on the corrected data voltage and a current flowing through the second drive transistor based on the corrected data voltage are supplied to the display element as drive currents;

the first conduction terminal of the first drive transistor is connected to the display element via the first emission control switching element;

a first conduction terminal of the second drive transistor is connected to the display element via the second emission control switching element; and control terminals of the first and second drive transistors are connected to each other and are connected to the holding capacitor.

2. The pixel circuit according to claim 1, wherein a channel width of the first drive transistor is smaller than a channel width of the second drive transistor.

3. The pixel circuit according to claim 2, wherein the channel width of the first drive transistor is 3 μm or more and 10 μm or less, and the channel width of the second drive transistor is 100 μm or more and 120 μm or less.

4. The pixel circuit according to claim 1, wherein the display portion is provided with a plurality of emission control lines along the plurality of scanning signal lines, and the control terminals of the first and second emission control switching elements are connected to one common emission control line disposed along the corresponding scanning signal line.

5. The pixel circuit according to claim 1, further comprising:

a first power supply voltage line;

a writing control switching element; and a power supply switching element, wherein the second conduction terminals of the first and second drive transistors are connected to a corresponding data signal line via the writing control switching element and are connected to the first power supply voltage line via the power supply switching element, and the control terminals of the first and second drive transistors are connected to the first power supply voltage line via the holding capacitor.

6. The pixel circuit according to claim 1, further comprising:

a first power supply voltage line;

a writing control switching element; and a power supply switching element, wherein the second conduction terminal of the first drive transistor is connected to a corresponding data signal line via the writing control switching element and is connected to the first power supply voltage line via the power supply switching element, the second conduction terminal of the second drive transistor is connected to the corresponding data signal line via the power supply switching element and the writing control switching element and is connected to the first power supply voltage line, and the control terminals of the first and second drive transistors are connected to the first power supply voltage line via the holding capacitor.

7. The pixel circuit according to claim 5, wherein the display portion is provided with a plurality of emission control lines along the plurality of scanning signal lines, a control terminal of the writing control switching element is connected to a corresponding scanning signal line, and control terminals of the first and second emission control switching elements and the power supply switching element are connected to one common emission control line disposed along the corresponding scanning signal line.

8. The pixel circuit according to claim 1, further comprising a third drive transistor configured to supply a current corresponding to the holding voltage of the holding capacitor to the display element during the display period, wherein the first and second conduction terminals of the third drive transistor are connected to the first and second conduction terminals of the second drive transistor, respectively, and control terminals of the first to third drive transistors are connected to each other and are connected to the holding capacitor.

9. The pixel circuit according to claim 8, further comprising:

a first power supply voltage line;

a writing control switching element; and a power supply switching element, wherein the second conduction terminal of the first drive transistor is connected to a corresponding data signal line via the writing control switching element and are connected to the first power supply voltage line via the power supply switching element, and the control terminals of the first to third drive transistors are connected to the first power supply voltage line via the holding capacitor.

10. The pixel circuit according to claim 9, wherein the second conduction terminals of the second and third drive transistors are connected to the corresponding data signal line via the writing control switching element and are connected to the first power supply voltage line via the power supply switching element.

11. The pixel circuit according to claim 9, wherein the second conduction terminals of the second and third drive transistors are connected to the corresponding data signal line via the power supply switching element and the writing control switching element and are connected to the first power supply voltage line.

12. The pixel circuit according to claim 8, wherein a channel width of the third drive transistor is equal to a channel width of the second drive transistor.

13. The pixel circuit according to claim 5, further comprising a second power supply voltage line, wherein the first conduction terminal of the first drive transistor is connected to the second power supply voltage line via the first emission control switching element and the display element, and the first conduction terminal of the second drive transistor is connected to the second power supply voltage line via the second emission control switching element and the display element.

14. A display device including a display portion in which a plurality of data signal lines and a plurality of scanning signal lines intersecting the plurality of data signal lines are disposed, the display device comprising:

a plurality of the pixel circuits according to claim 1 disposed along the plurality of data signal lines and the plurality of scanning signal lines such that each of the pixel circuits corresponds to any one of the plurality of data signal lines and corresponds to any one of the plurality of scanning signal lines;

a data signal line drive circuit configured to drive the plurality of data signal lines; and a scanning signal line drive circuit configured to selectively drive the plurality of scanning signal lines.

15. The display device according to claim 14, wherein the display portion includes a semiconductor layer and a gate insulating film for forming the first and second drive transistors, first display wiring formed on the gate insulating film, a first insulating film formed to cover the first display wiring, second display wiring formed on the first insulating film, a second insulating film formed to cover the second display wiring, and third display wiring formed on the second insulating film, and in each of the plurality of the pixel circuits, the control terminal of the first drive transistor and the control terminal of the second drive transistor are electrically connected to each other via a contact hole provided through the first insulating film and the second insulating film and via a connection wiring included in the third display wiring.

16. The display device according to claim 15, wherein in each of the plurality of the pixel circuits, an electrode of the holding capacitor is formed of the second display wiring, and the electrode is superimposed on the first drive transistor.

17. A method for driving a pixel circuit provided to correspond to any one of a plurality of data signal lines and correspond to any one of a plurality of scanning signal lines intersecting the plurality of data signal lines in a display device including a display portion in which the plurality of data signal lines and the plurality of scanning signal lines are arranged, the pixel circuit including a display element driven by a current, a holding capacitor, first and second drive transistors each configured to supply a current corresponding to a holding voltage of the holding capacitor to the display element, and a threshold compensation switching element that is connected between a control terminal and a first conduction terminal of the first drive transistor and is turned on to set the first drive transistor in a diode connection mode, the method comprising:

a data writing step of turning on the threshold compensation switching element to set the first drive transistor in a diode connection mode, and supplying a voltage of a data signal line corresponding to the pixel circuit to the holding capacitor via the first drive transistor in a diode connection mode to write to the holding capacitor a data voltage corrected so as to compensate a threshold of the first drive transistor; and a display step of supplying the display element with a current flowing through the first drive transistor based on the corrected data voltage and a current flowing through the second drive transistor based on the corrected data voltage as drive currents to cause the display element to emit light.

18. The driving method according to claim 17, wherein a channel width of the first drive transistor is smaller than a channel width of the second drive transistor.

19. The driving method according to claim 17, wherein the pixel circuit further includes first and second emission control switching elements, the first conduction terminal of the first drive transistor is connected to the display element via the first emission control switching element, a first conduction terminal of the second drive transistor is connected to the display element via the second emission control switching element, control terminals of the first and second drive transistors are connected to each other and are connected to the holding capacitor, in the data writing step, the first and second emission control switching elements are turned off, and in the display step, the first and second emission control switching elements are turned on.

* * * * *